US009175235B2

(12) United States Patent
Kastner et al.

(10) Patent No.: US 9,175,235 B2
(45) Date of Patent: Nov. 3, 2015

(54) TORREFACTION REDUCTION OF COKE FORMATION ON CATALYSTS USED IN ESTERIFICATION AND CRACKING OF BIOFUELS FROM PYROLYSED LIGNOCELLULOSIC FEEDSTOCKS

(71) Applicant: University of Georgia Research Foundation, Inc., Athens, GA (US)

(72) Inventors: James R. Kastner, Athens, GA (US); Sudhagar Mani, Watkinsville, GA (US); Roger Hilten, Winterville, GA (US); Keshav C. Das, Athens, GA (US)

(73) Assignee: UNIVERSITY OF GEORGIA RESEARCH FOUNDATION, INC., Athens, GA (US)

( * ) Notice: Subject to any disclaimer, the term of this patent is extended or adjusted under 35 U.S.C. 154(b) by 148 days.

(21) Appl. No.: 14/080,153

(22) Filed: Nov. 14, 2013

(65) Prior Publication Data

US 2014/0130402 A1 May 15, 2014

Related U.S. Application Data

(60) Provisional application No. 61/726,751, filed on Nov. 15, 2012.

(51) Int. Cl.
*C10L 1/02* (2006.01)
*C10G 1/00* (2006.01)

(52) U.S. Cl.
CPC .. *C10L 1/02* (2013.01); *C10G 1/002* (2013.01)

(58) Field of Classification Search
CPC ..... C10L 1/02; C10G 1/002
See application file for complete search history.

(56) References Cited

U.S. PATENT DOCUMENTS

| | | | | |
|---|---|---|---|---|
| 7,942,942 | B2 | 5/2011 | Paoluccio | |
| 8,048,178 | B2 | 11/2011 | Smit et al. | |
| 8,063,258 | B2 | 11/2011 | Bartek et al. | |
| 8,083,900 | B2 | 12/2011 | Lin | |
| 8,100,990 | B2 * | 1/2012 | Ellens | C10B 49/10 201/13 |
| 8,105,400 | B2 | 1/2012 | Bergman | |
| 8,182,561 | B2 | 5/2012 | Van Der Ploeg | |
| 8,198,493 | B1 | 6/2012 | Livingston et al. | |
| 8,203,024 | B2 | 6/2012 | Leonhardt | |
| 8,217,212 | B2 | 7/2012 | Paoluccio et al. | |
| 8,231,696 | B2 | 7/2012 | Ruiters | |
| 8,246,788 | B2 | 8/2012 | Teal et al. | |
| 8,252,966 | B2 | 8/2012 | Teal et al. | |
| 8,276,289 | B2 | 10/2012 | Causer | |
| 8,282,694 | B2 | 10/2012 | Hitchingham et al. | |
| 8,288,600 | B2 | 10/2012 | Bartek et al. | |

(Continued)

*Primary Examiner* — Cephia D Toomer
(74) *Attorney, Agent, or Firm* — Thomas | Horstemeyer, LLP

(57) ABSTRACT

A bio-oil production process involving torrefaction pretreatment, catalytic esterification, pyrolysis, and secondary catalytic processing significantly reduces yields of reactor char, catalyst coke, and catalyst tar relative to the best-case conditions using non-torrefied feedstock. The reduction in coke as a result of torrefaction was 28.5% relative to the respective control for slow pyrolysis bio-oil upgrading. In fast pyrolysis bio-oil processing, the greatest reduction in coke was 34.9%. Torrefaction at 275° C. reduced levels of acid products including acetic acid and formic acid in the bio-oil, which reduced catalyst coking and increased catalyst effectiveness and aromatic hydrocarbon yields in the upgraded oils. The process of bio-oil generation further comprises a catalytic esterification of acids and aldehydes to generate such as ethyl levulinate from lignified biomass feedstock.

18 Claims, 17 Drawing Sheets

(56) References Cited

U.S. PATENT DOCUMENTS

| | | | |
|---|---|---|---|
| 8,293,952 | B2 | 10/2012 | Levin |
| 8,304,590 | B2 | 11/2012 | Hopkins et al. |
| 8,322,056 | B2 | 12/2012 | Causer |
| 8,323,456 | B2 | 12/2012 | Lin et al. |
| 8,377,152 | B2 | 2/2013 | Ramirez Corredores et al. |
| 8,388,813 | B1 | 3/2013 | Livingston et al. |
| 8,435,314 | B2 | 5/2013 | Ruiters |
| 8,449,631 | B2 | 5/2013 | Paoluccio |
| 8,449,724 | B2 | 5/2013 | Stromberg et al. |
| 8,454,712 | B2 | 6/2013 | Ramirez Corredores et al. |
| 8,460,406 | B2 | 6/2013 | Lemaire et al. |
| 8,506,658 | B2 | 8/2013 | Corredores et al. |
| 8,623,634 | B2 * | 1/2014 | Yanik ..... C05F 11/00 201/25 |
| 8,779,225 | B2 * | 7/2014 | Boon ..... B01J 8/0055 422/139 |
| 8,927,794 | B2 * | 1/2015 | Boon ..... B01J 29/90 585/240 |
| 2003/0221363 | A1 | 12/2003 | Reed |
| 2007/0266623 | A1 | 11/2007 | Paoluccio |
| 2008/0022595 | A1 | 1/2008 | Lemaire et al. |
| 2008/0223269 | A1 | 9/2008 | Paoluccio |
| 2009/0077892 | A1 | 3/2009 | Shulenberger et al. |
| 2009/0084029 | A1 | 4/2009 | Bergman |
| 2009/0151251 | A1 | 6/2009 | Manzer et al. |
| 2009/0151253 | A1 | 6/2009 | Manzer et al. |
| 2009/0178336 | A1 | 7/2009 | Van Der Ploeg |
| 2009/0183431 | A1 | 7/2009 | Smit et al. |
| 2009/0250331 | A1 | 10/2009 | Hopkins et al. |
| 2009/0272027 | A1 | 11/2009 | Ruiters |
| 2010/0005709 | A1 | 1/2010 | Bradin |
| 2010/0101141 | A1 | 4/2010 | Shulenberger et al. |
| 2010/0242351 | A1 | 9/2010 | Causer |
| 2010/0242353 | A1 | 9/2010 | Jovanovic et al. |
| 2010/0251616 | A1 | 10/2010 | Paoluccio et al. |
| 2010/0270506 | A1 | 10/2010 | Goetsch et al. |
| 2011/0041392 | A1 | 2/2011 | Stromberg et al. |
| 2011/0041405 | A1 | 2/2011 | Hannemann et al. |
| 2011/0057060 | A1 | 3/2011 | Sprouse |
| 2011/0099888 | A1 | 5/2011 | Bartek et al. |
| 2011/0124748 | A1 | 5/2011 | Kuku |
| 2011/0138681 | A1 | 6/2011 | Ramirez Corredores et al. |
| 2011/0139597 | A1 | 6/2011 | Lin |
| 2011/0139602 | A1 | 6/2011 | Lin et al. |
| 2011/0146156 | A1 | 6/2011 | Kara et al. |
| 2011/0154720 | A1 | 6/2011 | Bartek et al. |
| 2011/0173888 | A1 | 7/2011 | Hitchingham et al. |
| 2011/0179700 | A1 | 7/2011 | Monroe et al. |
| 2011/0179701 | A1 | 7/2011 | Grassi |
| 2011/0209977 | A1 | 9/2011 | Rolland et al. |
| 2011/0214343 | A1 | 9/2011 | Wechsler et al. |
| 2011/0219679 | A1 | 9/2011 | Budarin et al. |
| 2011/0245545 | A1 | 10/2011 | Levin |
| 2011/0252698 | A1 | 10/2011 | Camper et al. |
| 2011/0265734 | A1 | 11/2011 | Kim et al. |
| 2011/0314728 | A1 | 12/2011 | Camper et al. |
| 2012/0017492 | A1 | 1/2012 | Ramirez et al. |
| 2012/0017499 | A1 | 1/2012 | Leonhardt |
| 2012/0023813 | A1 | 2/2012 | Sethi et al. |
| 2012/0042567 | A1 | 2/2012 | Rawls et al. |
| 2012/0060408 | A1 | 3/2012 | Bartek et al. |
| 2012/0060412 | A1 | 3/2012 | Raiko |
| 2012/0067773 | A1 | 3/2012 | Ditsch |
| 2012/0085023 | A1 | 4/2012 | Teal et al. |
| 2012/0093701 | A1 | 4/2012 | Paoluccio |
| 2012/0101318 | A1 | 4/2012 | Ramirez Corredores et al. |
| 2012/0108860 | A1 | 5/2012 | Daugaard et al. |
| 2012/0110896 | A1 | 5/2012 | Coronella et al. |
| 2012/0116135 | A1 | 5/2012 | Gong et al. |
| 2012/0117815 | A1 | 5/2012 | Wechsler et al. |
| 2012/0124901 | A1 | 5/2012 | Paoluccio |
| 2012/0137538 | A1 | 6/2012 | Lampe et al. |
| 2012/0144730 | A1 | 6/2012 | Stamires et al. |
| 2012/0145965 | A1 | 6/2012 | Simmons et al. |
| 2012/0159842 | A1 | 6/2012 | Teal et al. |
| 2012/0160658 | A1 | 6/2012 | Bartek et al. |
| 2012/0172643 | A1 | 7/2012 | Ramirez Corredores et al. |
| 2012/0192485 | A1 | 8/2012 | Grassi et al. |
| 2012/0193581 | A1 | 8/2012 | Goetsch et al. |
| 2012/0196238 | A1 | 8/2012 | Goetsch et al. |
| 2012/0204481 | A1 | 8/2012 | Corredores et al. |
| 2012/0204482 | A1 | 8/2012 | Heimann |
| 2012/0216448 | A1 | 8/2012 | Ramirez Corredores et al. |
| 2012/0232299 | A1 | 9/2012 | Bartek et al. |
| 2012/0233914 | A1 | 9/2012 | Causer |
| 2012/0260564 | A1 | 10/2012 | Ramirez Corredores et al. |
| 2012/0261245 | A1 | 10/2012 | Breneman |
| 2012/0261246 | A1 | 10/2012 | Ben-Tovim |
| 2012/0266485 | A1 | 10/2012 | Abraham et al. |
| 2012/0266525 | A1 | 10/2012 | Gosselink et al. |
| 2012/0266526 | A1 | 10/2012 | Ramirez Corredores et al. |
| 2012/0266531 | A1 | 10/2012 | Hitchingham et al. |
| 2012/0266838 | A1 | 10/2012 | Gosselink et al. |
| 2012/0271073 | A1 | 10/2012 | Boon et al. |
| 2012/0271074 | A1 | 10/2012 | Boon et al. |
| 2012/0271075 | A1 | 10/2012 | Harris et al. |
| 2012/0273419 | A1 | 11/2012 | Fried |
| 2012/0277330 | A1 | 11/2012 | Goetsch et al. |
| 2012/0277499 | A1 | 11/2012 | Boon et al. |
| 2012/0279115 | A1 | 11/2012 | Ruiters |
| 2012/0289752 | A1 | 11/2012 | Gosselink et al. |
| 2012/0291340 | A1 | 11/2012 | Boon et al. |
| 2012/0315681 | A1 | 12/2012 | van Walsem et al. |
| 2012/0322130 | A1 | 12/2012 | Garcia-Perez et al. |
| 2013/0012376 | A1 | 1/2013 | Bartek et al. |
| 2013/0029101 | A1 | 1/2013 | Trewalla et al. |
| 2013/0029168 | A1 | 1/2013 | Trewella et al. |
| 2013/0055631 | A1 | 3/2013 | Camper et al. |
| 2013/0055633 | A1 | 3/2013 | Causer |
| 2013/0075244 | A1 | 3/2013 | Eyer et al. |
| 2013/0098751 | A1 | 4/2013 | Eyer et al. |
| 2013/0104450 | A1 | 5/2013 | Dodson et al. |
| 2013/0104451 | A1 | 5/2013 | Carlin et al. |
| 2013/0105295 | A1 | 5/2013 | Eyer et al. |
| 2013/0109892 | A1 | 5/2013 | Harris et al. |
| 2013/0109894 | A1 | 5/2013 | Trewella |
| 2013/0110291 | A1 | 5/2013 | Carlin et al. |
| 2013/0118059 | A1 | 5/2013 | Lange et al. |
| 2013/0131196 | A1 | 5/2013 | Cheiky et al. |
| 2013/0137154 | A1 | 5/2013 | Reep |
| 2013/0139432 | A1 | 6/2013 | Shu et al. |
| 2013/0143972 | A1 | 6/2013 | Townsend et al. |
| 2013/0143973 | A1 | 6/2013 | Townsend et al. |
| 2013/0144087 | A1 | 6/2013 | Arora |
| 2013/0167430 | A1 | 7/2013 | Harris et al. |
| 2013/0178672 | A1 | 7/2013 | Chen et al. |
| 2013/0199919 | A1 | 8/2013 | Li et al. |
| 2013/0205651 | A1 | 8/2013 | Wang et al. |
| 2013/0228444 | A1 | 9/2013 | Teal et al. |
| 2013/0232856 | A1 | 9/2013 | Clingan |
| 2013/0232863 | A1 | 9/2013 | Stromberg et al. |
| 2013/0232869 | A1 | 9/2013 | Yu et al. |
| 2013/0247448 | A1 | 9/2013 | Ampulski et al. |
| 2013/0247449 | A1 | 9/2013 | Castellv Barnes et al. |
| 2013/0248760 | A1 | 9/2013 | Ampulski et al. |
| 2013/0248767 | A1 | 9/2013 | Ampulski et al. |
| 2013/0256113 | A1 | 10/2013 | Tumiatti et al. |

* cited by examiner

TORREFACTION REDUCTION OF COKE FORMATION ON CATALYSTS USED IN ESTERIFICATION AND CRACKING OF BIOFUELS FROM PYROLYSED LIGNOCELLULOSIC FEEDSTOCKS

CROSS-REFERENCE TO RELATED APPLICATIONS

This application claims priority to U.S. Provisional Patent Application Ser. No. 61/726,751, entitled "TORREFACTION PRETREATMENT SIGNIFICANTLY REDUCES CATALYST COKE WHEN UPGRADING PYROLYSIS BIO-OIL TO DROP-IN FUELS USING HZSM-5" filed on Nov. 15, 2012, the entirety of which is hereby incorporated by reference.

STATEMENT OF REGARDING FEDERALLY SPONSORED RESEARCH OR DEVELOPMENT

This invention was made with government support under DOE Grant No.: DEFG 3608GO88144 awarded by the U.S. Department of Energy of the United States government. The government has certain rights in the invention.

TECHNICAL FIELD

The present disclosure is generally related to methods of reducing coke formation on catalysts used in pyrolysis generation of biofuels from lignocellulosic feedstocks.

BACKGROUND

Catalytic cracking has been shown to improve the quality of pyrolysis oils generated from a variety of high oxygen content feedstocks including rice husks, rice straw (Chen et al., (2003) *Energy Conversion & Management* 44: 1875-1884), pine wood (Carlson et al., (2011) *Energy Environ. Sci.* 4: 145-161; Chen et al., (2003) *Energy Conversion and Management* 44: 1875-1884; Valle et al., (2007). *Int. Chem. Reactor Engineering* 5: 1-10), maple wood (Adjaye & Bakhshi (1995) *Fuel Processing Technol.* 45: 185-202; Adjaye & Bakhshi (1995) *Fuel Processing Technol.* 45: 161-183), and poplar wood (Lu et al., (2010) *Fuel* 89: 2096-2103).

The cracking process was developed by the petroleum industry to crack and rearrange high boiling, high molecular weight petroleum crude oil fractions to yield predominantly gasoline and other light hydrocarbons (Corma et al., (2007) *J. Catalysis* 247: 302-327). Cracking catalysts generally used for treating biomass-derived oils have been acidic zeolites with ion exchange capacity and size selectivity functionality. They have also been shown to effectively deoxygenate bio-oil feedstocks and form desirable end-products, including small alkanes and aromatics (Park et al., (2010) *Appl. Catalysis B: Environmental* 95: 365-373; Corma et al., (2007) *J. Catalysis* 247: 302-327; Adjaye & Bakhshi (1995) *Fuel Processing Technol.* 45: 185-202).

Catalyst coking, however, is a significant problem that progressively reduces the effectiveness of the catalyst. Many studies have sought methods to reduce coke formation (Corma et al., (2007) *J. Catalysis* 247: 302-327; Valle et al., (2007). *Int. Chem. Reactor Engineering* 5: 1-10; Elliott & Neuenschwander (1996) in: Bridgwater & Boocock (Eds.), Developments in Thermochemical Biomass Conversion. Blackie Academic & Professional, London, Vol. 1, pp. 611-621). Adjaye and Bakhshi (Adjaye & Bakhshi (1995) *Fuel Processing Technol.* 45: 185-202; 161-183) attempted to catalytically crack fast pyrolysis bio-oil with five different catalysts (ZSM-5, H-Y-zeolite, H-mordenite, silicalite, and silica-alumina). While the yield of organic liquid product was highest with ZSM-5 (34% w/w of feed), the coke yield was also significant at 20-29 wt %. If coking can be reduced, catalytic upgrading using acid zeolites would become an economically viable method to produce hydrocarbon fuels from lignocellulosic feedstocks.

One way to minimize coke formation on zeolite catalysts is to remove coke precursors from the oil prior to cracking upgrading. Compounds that are considered to promote coke formation include aldehydes, oxyphenols, furfural, and lignin-derived oligomers (Gagnon & Kaliaguine (1988) *Ind. Eng. Chem. Res.* 27: 1783-1788; Lu et al., (2010) *Fuel* 89: 2096-2103). Other attempted methods have involved hydrotreating of bio-oil (Gagnon & Kaliaguine (1988) *Ind. Eng. Chem. Res.* 27: 1783-1788; Laurent & Delmon (1994) *Applied Catalysis A: General* 109: 77-96; Centeno et al., (1995) *J. Catalysis* 154: 288-298; Wildschut et al., (2009) *Ind. Eng. Chem. Res.* 48: 10324-10334). The studies have indicated that the carbohydrate fraction is a major contributor to coke formation. There is, however, currently little research that attempts to remove coke precursors from bio-oil before upgrading.

SUMMARY

One aspect of the disclosure, therefore, encompasses embodiments of a method for reducing coke deposition on a catalyst used in cracking of a pyrolysis oil vapor, the method comprising: (a) subjecting a biomass to torrefaction; (b) pyrolyzing the torrefaction-treated biomass, thereby generating a heated pyrolysis oil vapor; (c) catalytically esterifying the heated pyrolysis oil vapor or components thereof, thereby providing a heated pyrolysis oil vapor having a reduced acid and aldehyde content compared to a heated pyrolysis oil vapor not catalytically esterified; and (d) cracking the catalytically esterified heated pyrolysis oil vapor, thereby generating a bio-oil, wherein said cracking step comprises contacting the heated pyrolysis oil vapor with a second catalyst, and wherein said catalyst accumulates a reduced coke deposition compared to when the heated pyrolysis oil vapor is generated from a biomass not treated with torrefaction.

In embodiments of this aspect of the disclosure, the heated pyrolysis oil vapor can be contacted with an aqueous composition comprising at least one alcohol and a first catalyst selected to catalyze the esterification of at least one component of the heated pyrolysis oil vapor.

Another aspect of the disclosure encompasses embodiments of a method of generating a bio-oil from a biomass, the method comprising: (a) subjecting a biomass to torrefaction, wherein the torrefaction comprises heating the biomass at a temperature of between about 100° C. to about 300° C. in an inert gas; (b) pyrolyzing the torrefaction-treated biomass by fast pyrolysis, thereby generating a heated pyrolysis oil vapor; (c) catalytically esterifying the heated pyrolysis oil vapor or components thereof, thereby providing a heated pyrolysis oil vapor having a reduced acid and aldehyde content compared to a heated pyrolysis oil vapor not catalytically esterified, wherein the heated pyrolysis oil vapor from step (b) is contacted with an aqueous composition comprising at least one alcohol and a first catalyst selected to catalyze the esterification of at least one component of the heated pyrolysis oil vapor; and (d) cracking the catalytically esterified heated pyrolysis oil vapor, thereby generating a bio-oil, wherein said cracking step comprises contacting the heated pyrolysis oil vapor with a second catalyst, and wherein said catalyst accumulates a reduced coke deposition compared to when the heated pyrolysis oil vapor is generated from a biomass not treated with torrefaction.

Yet another aspect of the disclosure encompasses embodiments of a bio-oil product generated by the process according to the disclosure.

Still another aspect of the disclosure encompasses embodiments of a system for generating a pyrolysis bio-oil product according to the process of the disclosure, the system comprising a torrefaction unit, a pyrolysis unit, a catalytic esterification unit, a catalytic cracking unit, and optionally a condensation unit.

BRIEF DESCRIPTION OF THE DRAWINGS

Aspects of the present disclosure will be more readily appreciated upon review of the detailed description of its various embodiments, described below, when taken in conjunction with the accompanying drawings.

FIG. 4A, levoglucosan; FIG. 4B, formic acid; FIG. 4C, acetic acid; FIG. 4D, 5-HMF; FIG. 4E, furfural.

DETAILED DESCRIPTION

Figure 1:
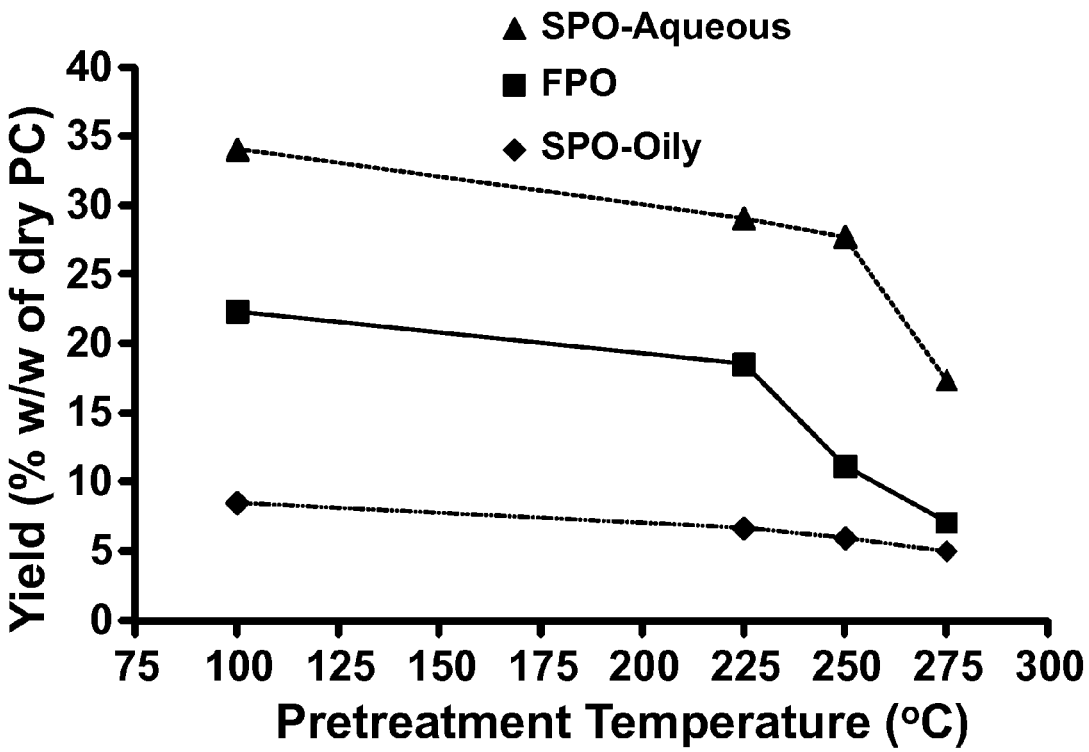
FIG. 1 is a graph illustrating the yield of oily and aqueous phase oil from pyrolysis of torrefied pine chips biomass relative to dry pine chips feedstock.

Before the present disclosure is described in greater detail, it is to be understood that this disclosure is not limited to particular embodiments described, and as such may, of course, vary. It is also to be understood that the terminology used herein is for the purpose of describing particular embodiments only, and is not intended to be limiting, since the scope of the present disclosure will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Embodiments of the present disclosure will employ, unless otherwise indicated, techniques of medicine, organic chemistry, biochemistry, molecular biology, pharmacology, and the like, which are within the skill of the art. Such techniques are explained fully in the literature.

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

As used herein, the following terms have the meanings ascribed to them unless specified otherwise. In this disclosure, "comprises," "comprising," "containing" and "having" and the like can have the meaning ascribed to them in U.S. Patent law and can mean "includes," "including," and the like; "consisting essentially of" or "consists essentially" or the like, when applied to methods and compositions encompassed by the present disclosure refers to compositions like those disclosed herein, but which may contain additional structural groups, composition components or method steps (or analogs or derivatives thereof as discussed above). Such additional structural groups, composition components or method steps, etc., however, do not materially affect the basic and novel characteristic(s) of the compositions or methods, compared to those of the corresponding compositions or methods disclosed herein.

Abbreviations

PFR, fixed-bed plug flow reactor unit; BSPU, batch slow pyrolysis unit; FBPU, continuous flow fluidized bed pyrolysis unit; PC, pine chip; TPC, torrefied pine chip; WHSV, weight hourly space velocity; LHSV, reactant liquid flow rate; FP, fast pyrolysis; SP, slow pyrolysis; FPO, fast pyrolysis oil; SPO, slow pyrolysis oil; TAM, toluene-acetone-methanol; TCD, thermal conductivity detector; BTEX, benzene, toluene, ethylbenzene, and xylenes.

Definitions

In describing and claiming the invention, the following terminology will be used in accordance with the definitions set forth below.

The term "torrefaction" as used herein refers to a mild form of pyrolysis of a biomass at temperatures typically ranging between 200 and 320° C. It is carried out under atmospheric pressure and in the absence of oxygen, i.e. with no air. During torrefaction, the biomass properties are changed to obtain a much better fuel quality for combustion and gasification applications. Torrefaction leads to a dry product with no biological activity like rotting. Torrefaction combined with densification leads to a very energy-dense fuel carrier of 20 to 25 GJ/ton lower heating value (LHV).

The term "pyrolysis" as used herein refers to the process of heating of a biomass in an oxygen-poor or oxygen-free atmosphere. The term "oxygen-poor" as used herein refers to an atmosphere containing less oxygen than ambient air. In general, the amount of oxygen should be such as to avoid combustion of the biomass material, or vaporized and gaseous products emanating from the biomass material, at the pyrolysis temperature. Preferably the atmosphere is essentially oxygen-free, that is, contains less than about 1 wt % oxygen.

Pyrolysis as used herein may further refer to processes for converting all or part of the biomass to bio-oil by heating the biomass either with an inorganic particulate inert material (such as sand) or with a catalytic material (sometimes referred to as catalytic pyrolysis or biomass catalytic cracking). If the heat carrier material is a catalytic material, it can be selected from the group consisting of: a solid base, a clay, an inorganic oxide, an inorganic hydroxide, a zeolite, a supported metal, and combinations thereof. The solid base can be selected from the group consisting of: hydrotalcite; a hydrotalcite-like material; a clay; a layered hydroxy salt; a metal oxide; a metal hydroxide; a mixed metal oxide; or a mixture thereof.

The term "biomass" as used herein refers to a material useful in the process of the disclosure that is capable of being converted to liquid and gaseous hydrocarbons. Preferred biomass material is solid biomass material comprising cellulose such as, but not limited to, lignocellulosic materials, because of the abundant availability of such materials, and their low cost. Examples of suitable solid biomass materials include forestry wastes, such as wood chips and saw dust; agricultural waste, such as straw, corn stover, sugar cane bagasse, municipal waste, in particular yard waste, paper, and card board; energy crops such as switch grass, coppice, eucalyptus; and aquatic materials such as algae; and the like. Biomass delivered to a system for conversion to a bio-oil is herein referred to as a "feedstock."

The term "bio-oil" as used herein refers to a mixture of water, light volatiles, and non-volatiles and is highly reactive because of the presence of significant quantities of oxygen. The bio-oil typically is a complex mixture of chemical species that result from the decomposition of cellulose, hemicellulose, and lignin. There are over 300 compounds that have been identified as present in bio-oils, depending on the source and process for its generation, that include, but are not limited to, hydroxy-aldehydes, hydroxyketones, sugars, carboxylic acids, and phenolics. The abundance of these chemical species in bio-oil resemble the complexity of crude petroleum oils, and thus an attractive resource for obtaining chemicals and fuels.

The term "tar" as used herein refers to compounds, typically organic compounds that can be deposited at process temperatures where a deposit can be characterized as a non-flowing liquid, a semi-solid or a solid. Bio-oil production processes and equipment used in such processes have been plagued with the co-production of viscous, condensable compounds which tend to deposit and adhere to downstream equipment, reactors, catalysts, and the like where the fluid reactant streams cool. Primary tars are formed in the initial volatization process but are somewhat unstable and react chemically or dehydrogenate to form secondary and tertiary tars which are more difficult to react or re-hydrogenate than primary tars. In certain processes, the tars form solid particles of char and are no longer condensable but are still not desirable for commercial use.

The term "catalyst" as used herein may refers to "fluid catalytic cracking (FCC) catalysts that are powders with a bulk density of 0.80 to 0.96 g/cm$^3$ and having a particle size distribution ranging from 10 to 150 μm and an average particle size of 60 to 100 μm. Typically, but not limiting, an FCC catalyst can have four major components: crystalline zeolite, matrix, binder, and filler. Zeolite is the primary active component and can range from about 15 to 50 weight percent of the catalyst. The zeolite used in FCC catalysts is composed of silica and alumina tetrahedra with each tetrahedron having either an aluminum or a silicon atom at the center and four oxygen atoms at the corners. It is a molecular sieve with a distinctive lattice structure that allows only a certain size range of hydrocarbon molecules to enter the lattice. In general, the zeolite does not allow molecules larger than 8 to 10 nm to enter the lattice.

The catalytic sites in the zeolite are strong acids and provide most of the catalytic activity. The acidic sites are provided by the alumina tetrahedra. The aluminum atom at the center of each alumina tetrahedra is at a $^{+}3$ oxidation state surrounded by four oxygen atoms at the corners which are shared by the neighboring tetrahedra. Thus, the net charge of the alumina tetrahedra is −1 which is balanced by a sodium ion during the production of the catalyst. The sodium ion is later replaced by an ammonium ion, which is vaporized when the catalyst is subsequently dried, resulting in the formation of Lewis and Brφnsted acidic sites. In some catalysts, the Brφnsted sites may be later replaced by rare earth metals such as cerium and lanthanum and the like to provide alternative activity and stability levels.

The matrix component of an FCC catalyst contains amorphous alumina which also provides catalytic activity sites and in larger pores that allows entry for larger molecules than does the zeolite. That enables the cracking of higher-boiling, larger feedstock molecules than are cracked by the zeolite.

The binder and filler components provide the physical strength and integrity of the catalyst. The binder is usually silica sol and the filler is usually a clay (kaolin).

The term "Heating Value" (or "energy value" or "calorific value") as used herein refers to the amount of heat released during the combustion of a specified amount of it. The energy value is a characteristic for each substance. It is measured in units of energy per unit of the substance, usually mass, such as: kJ/kg, kJ/mol, kcal/kg, Btu/lb. Heating value is commonly determined by use of a bomb calorimeter.

The heat of combustion for fuels is expressed as the HHV, LHV, or GHV. The quantity known as higher heating value (HHV) (or gross energy or upper heating value or gross calorific value (GCV) or higher calorific value (HCV)) is determined by bringing all the products of combustion back to the original pre-combustion temperature, and in particular condensing any vapor produced. Such measurements often use a standard temperature of 25° C. The higher heating value takes into account the latent heat of vaporization of water in the combustion products, and is useful in calculating heating values for fuels where condensation of the reaction products is practical (e.g., in a gas-fired boiler used for space heat). HHV assumes all the water component is in liquid state at the end of combustion (in product of combustion) and that heat above 150° C. can be put to use.

Description

Biomass fast pyrolysis (FP) is a rapid thermal process (0.5-5 sec) that generates high yields (60-75%) of an energy dense, liquid hydrocarbon (bio-oil) that can be catalytically converted to drop-in fuels. Technoeconomic analysis indicates that among all conversion technologies, FP has the highest probability of scale-up to produce liquid transportation fuels. However, due to the presence of water (30-40%), reactive acids and aldehydes, and tars, the bio-oil is acidic (corrosive), unstable (increasing viscosity), and difficult to catalytically upgrade due to tars causing catalyst coking. Additionally, the aqueous phase of whole bio-oil contains greater than 5% of acetic acid, formic acid, levoglucosan, and acetol (1-hydroxy-2-propanone). However, these compounds are good candidates for catalytic transformation into more useful carbon-containing products such as esters of levulinic acid.

The present disclosure provides embodiments of a novel method combining the use of a solid acid catalyst and vapor/liquid processing to simultaneously convert acids to esters and levoglucosan to ethyl levulinate. This latter compound is an economically valuable platform chemical and drop-in fuel. Accordingly, the products and methods of the disclosure address a persistent challenge that currently limits bio-oil utilization (e.g. poor stability, corrosiveness, low yield, and low value).

Bio-oil contains many destabilizing compounds, most notably organic acids that promote condensation reactions resulting in polymerization of components during storage. Chemically bound and emulsified water, given its high concentration (20-30%), acts as a reactant and reaction medium. A process that removes organic acids from bio-oil, therefore, can significantly improve overall quality and stability of the product, while providing compounds that are in their own right valuable or can be converted into other useful compounds.

In whole bio-oil, undesirable compounds including acetic and formic acid are difficult to remove via conventional methods (i.e. distillation). Alternatively, acids can be transformed into more valuable products and then extracted. A common upgrading technique involves esterifying organic acids. Thus, when using ethanol the products of acetic and formic acid esterification are such as ethyl acetate and ethyl formate. Converting carboxylic acids in bio-oil, which are plentiful, to esters improves the overall quality of the product, i.e. acidity is lowered, stability is improved, and heating value increases. When acids in aqueous phase bio-oil are esterified in a liquid phase reaction, conversion and yields are limited due to the inhibition of esterification by $H_2O$ (i.e., equilibrium conversion is limited). However, this inhibition can be reduced by performing the reaction in a vapor/liquid state.

An anhydro-sugar stream can be generated via pyrolysis of cellulosic feedstocks. One of the primary products of cellulose fast pyrolysis is levoglucosan. Under acid-catalyzed conditions in the presence of water, levoglucosan hydrolyzes to glucose which undergoes dehydration to 5-(hydroxymethyl)-2-furaldehyde (hydroxymethylfurfural (HMF) and then hydrolysis to levulinic acid and formic acid. However, a significant amount of humic material is formed under water-rich conditions (Hu et al., (2011) *Green Chem.* 13: 1676-1679). Although levulinic acid is valuable as a platform molecule, it cannot be used directly as a fuel. However, when esterified with ethanol, the product formed is ethyl levulinate, a valuable platform molecule and a diesel miscible biofuel that forms at a theoretical yield of about 65% relative to levulinic acid (liquid phase). Ethyl levulinate mixed at 20% in diesel reduces sulfur emissions, increases viscosity and is cleaner burning due to the elevated oxygen content with no loss in fuel economy (Texaco/NYSERDA/Biofine (2000), Ethyl Levulinate D-975 Diesel Additive Test Program, Glenham, N.Y.).

In the absence of water (or high alcohol/water ratios), another route to ethyl levulinate from levoglucosan has been proposed. Hu et al. ((2011) *Green Chem.* 13: 1676-1679) reacted glucose and levoglucosan over an acid catalyst in a methanol-rich medium and noted that methyl a-D-glucopyranoside (MGP) and HMF formed, with HMF further converting via acetalization and etherification to 2-(dimethoxymethyl)-5-(methoxymethyl)furan (DMMF). DMMF is then esterified to methyl levulinate and methyl levulinate.

While not wishing to be bound by any one theory, according to Hu et al. (2011), the methanol-rich route limits the formation of humins and when using ethanol as opposed to methanol, ethyl α-D-glucopyranoside (EGP) and 5-ethoxymethylfurfural (EMF) likely form with EMF further converting to 5-(diethoxymethyl)-2-furanmethanol (DEF). DEF then degrades to ethyl formate and ethyl levulinate (proposed to form at a 1:1 molar ratio). Many studies have also shown both the conversion of biomass to sugars (via mineral acid hydrolysis), sugars to levulinic acid, and levulinic acid to levulinate esters but little if any research has attempted to transform a lignocellulosic biomass-derived sugar stream (i.e. levoglucosan) to ethyl levulinate under vapor/liquid phase conditions.

The pyrolysis process stands in contrast to mineral acid hydrolysis as a means to generate a feedstock, since it is easily scalable and does not require a difficult-to-recover homogeneous catalyst. When separated into predominantly phenolic heavy oil and an aqueous phase via water addition, the vast majority of levoglucosan, acetic acid, and formic acid migrate to the aqueous phase along with a number of other compounds (though substantially fewer compounds than in whole bio-oil) including, such as, but not limited to, 1-hydroxy-2-propanone. Each of these aqueous compounds undergoes transformation to higher value compounds under acid-catalyzed, vapor phase esterification conditions. Of particular interest and value are the products ethyl acetate, ethyl formate, and ethyl levulinate.

Pretreatment of biomass by torrefaction before pyrolysis provides a means to remove coke precursors from bio-oil prior to upgrading and thus reduce coke formation, improve bio-oil quality and catalyst effectiveness. Biomass torrefaction is a low temperature pyrolysis process, similar to coffee roasting, in which the biomass is heated in an inert environment such as nitrogen from about 200° C. to about 320° C. This process generates a hydrophobic, friable solid biomass that requires less energy for grinding compared to an untorrefied biomass (Phanphanich & Mani (2010) *Bioresource Technology* 102, 1246-1253). Improved grinding is of particular benefit for fluidized bed pyrolysis or gasification where small particle sizes are preferred.

Torrefied biomass has lower elemental oxygen content (CO, $H_2O$, and $CO_2$ are emitted during torrefaction) compared to untreated biomass (Tumuluru et al., (2012) *Energies* 5: 3928-3947). Additionally, torrefaction drives off reactive and acidic intermediate components including acids (e.g. acetic, formic, propionic) and aldehydes (e.g. formaldehyde, hydroxyacetaldehyde, acetaldehyde, furfural) (Bergman & Keil (2005) *Energy Environ. Sci.* 4: 145-161; Phanphanich & Mani (2010) *Bioresource Technology* 102, 1246-1253). Meng (Meng et al., (2012) *Bioresource Technol.* 111: 439-446) observed the effect of torrefaction pretreatment on the chemistry of fast pyrolysis bio-oil, noting that torrefaction resulted in a bio-oil with a larger fraction of pyrolytic lignin, implying that torrefaction effectively removed hemicellulose and some cellulose components. Although some reactive gases produced during the torrefaction phase of pyrolysis have been shown to generate coke on acid catalysts, leading to deactivation (Gayubo et al., (2004) *Energy and Fuels* 18: 1640-1647; Gayubo et al., (2005) *J. Chem. Technol. Biotechnol.* 80: 1244-1251), and despite the fact that the NSF/DOE Roadmap (2008) has indicated that the impact of torrefaction on thermochemical processing should be investigated, little research has been performed to determine the effect of torrefaction as a pretreatment for pyrolysis followed by catalytic cracking of the produced bio-oil.

Hemicellulose decomposition has been proposed to occur in the temperature range from 200-300° C. with drying occurring prior to 200° C. For cellulose, the temperature range of decomposition is 300-400° C. and for lignin is 250-500° C. (de Wild et al., (2009) *J. Anal. Appl. Pyrolysis* 85: 124-133). Thus, in the normal temperature range for torrefaction (200-320° C.), biomass is effectively dried and hemicellulose is devolatilized and decomposed along with some cellulose and lignin (Zheng et al., (2012) *Bioresour. Technol.* 128: 370-377). A variety of compounds are generated during torrefaction, including acetic acid, which is derived from the deacetylation of the xylan component of hemicellulose (Meng et al., (2012) *Bioresource Technol.* 111: 439-446; de Wild et al., (2009) *J. Anal. Appl. Pyrolysis* 85: 124-133).

Several hemicellulose-derived compounds that decompose to coke in the subsequent upgrading step, including acetyl groups that form acetic acid and other short chain carboxylic acids, are also removed via torrefaction (Prins et al., (2006) *J. Analytical Applied Pyrolysis* 77(1): 35-40; Perego & Bosetti (2011) *Microporous & Mesoporous Materials* 144: 28-39). Joo et al., (Joo et al., (2002) *Bull. Korean Chem. Soc.* 23: 1103-1105) showed that formaldehyde, another hemicellulose-derived compound, effectively deactivated strong acid sites on HZSM-5 catalysts. It has also been observed that measurable concentrations of aldehydes including formaldehyde, acetaldehyde, syringaldehyde, hydroxyacetaldehyde, and furfurals are formed during torrefaction. In addition, after upgrading bio-oil from non-torrefied feedstock, residual acetic acid ends up in the product causing high acidity (low pH).

The present disclosure, therefore, encompasses embodiments of a novel process that includes torrefaction as a biomass pretreatment step. Torrefaction was performed at 225° C., 250° C., or 275° C., a commonly-used temperature range for the partial or complete removal of hemicellulose, in a pilot-scale rotary kiln. In one embodiment of the torrefaction process, approximately 100 kg of air-dried pine chips (2-5 cm particle size) were loaded into the rotary kiln. The kiln was a 3 $m^3$ octagonal shaped mild steel reactor externally heated by a 22.9 MW (1.3 MMBTU $h^{-1}$) natural gas burner. The volume of the pine chips comprised less than 1 $m^3$ of the reactor volume. The axially-rotating system had ports allowing inert gas input though one end and exhaust output from a 41 cm pipe at the opposite end. Nitrogen was supplied concentric to the axis of rotation via a rotary union inlet from a liquid tank at 8-17 $m^3$ $h^{-1}$. An external motor controlled by a TECO Speecon 7300 CU controller (TECO Electric and Machinery Co., Taiwan) was used to maintain a rotation speed at 0.75 rpm selected to minimize size reduction of the material and fine dust formation. The system temperature was regulated by a Honeywell UDC2500 controller (Fort Washington, Pa., USA) allowing a setpoint temperature to be adjusted with a PID function relayed to the Maxon Model 400 natural gas burner (Honeywell, Muncie, Ind., USA). The burner was equipped with a Honeywell burner control UV flame amplifier. The temperature for maintaining setpoint was monitored at the wall of the reactor. Other temperature readings were recorded at 15 cm, 30 cm, and 45 cm from the axis of rotation inside the reactor to analyze the temperature distribution in the feedstock. An additional controller monitored the kiln upper setpoint with a thermocouple at the opposite end. Generated vapors were incinerated with a Midco Incinomite 29.3-234.5 kW (0.1-0.8 MMBTU $h^{-1}$) burner (Midco International, Chicago, Ill., USA) before exhausting. At each end temperature, a holding time of 20 min drove complete devolatilization of components. The resulting torrefied feedstocks (pine chips T225, pine chips T250, pine chips T275) were characterized (Table 1), ground to 1-2 mm, subjected to fast pyrolysis at 500° C. or left in chip form for slow pyrolysis. The condensable bio-oil was then catalytically cracked at 400° C., 450° C., and 500° C.

TABLE 1

Feedstock characteristics for torrefied and untorrefied pine chips biomass.

| Parameter | PC AVE | ± | 95% CI | PC T100 AVE | ± | 95% CI | PC T225 AVE | ± | 95% CI |
|---|---|---|---|---|---|---|---|---|---|
| Yield[a] | 100 | ± | N/A | 86.0 | ± | N/A | 71.2 | ± | N/A |
| Moisture[b] | 14.0 | ± | 0.32 | 0.03 | ± | 0.02 | 0.48 | ± | 0.28 |
| Volatiles | 82.0 | ± | 0.42 | 81.4 | ± | 0.02 | 80.0 | ± | 0.22 |
| Ash | 0.2 | ± | 0.03 | 0.30 | ± | 0.04 | 0.36 | ± | 0.03 |
| Fixed Carbon | 17.9 | ± | 0.39 | 18.3 | ± | 0.02 | 19.6 | ± | 0.24 |
| C | 46.9 | ± | 0.2 | 46.9 | ± | 0.2 | 48.3 | ± | 0.5 |
| H | 5.98 | ± | 0.1 | 5.98 | ± | 0.1 | 5.88 | ± | 0.1 |
| N | 0.45 | ± | 0.1 | 0.45 | ± | 0.1 | 0.88 | ± | 0.2 |
| S | 0 | ± | 0 | 0 | ± | 0 | 0 | ± | 0 |
| O[c] | 46.3 | ± | 0.2 | 46.3 | ± | 0.2 | 44.6 | ± | 0.2 |
| HHV[d] ($MJ\ kg^{-1}$) | 18.6 | ± | 0.1 | 18.6 | ± | 0.1 | 19.1 | ± | 0.1 |

| | PC T250 AVE | ± | 95% CI | PC T275 AVE | ± | 95% CI |
|---|---|---|---|---|---|---|
| Yield[a] | 69.7 | ± | N/A | 55.6 | ± | N/A |
| Moisture[b] | 0.35 | ± | 0.10 | 0.01 | ± | 0.02 |
| Volatiles | 77.9 | ± | 1.20 | 72.3 | ± | 0.47 |
| Ash | 0.39 | ± | 0.05 | 0.20 | ± | 0.16 |
| Fixed Carbon | 21.7 | ± | 1.15 | 27.5 | ± | 0.31 |
| C | 48.4 | ± | 0.1 | 53.3 | ± | 0.6 |
| H | 5.83 | ± | 0.1 | 5.6 | ± | 0 |
| N | 0.82 | ± | 0.1 | 1 | ± | 0.3 |
| S | 0 | ± | 0 | 0 | ± | 0 |
| O[c] | 44.6 | ± | 0.1 | 39.9 | ± | 0.5 |
| HHV[d] ($MJ\ kg^{-1}$) | 19.1 | ± | 0.1 | 21.1 | ± | 0.3 |

Including control samples that were dried at 100° C. and subsequently subjected to the catalytic process, 32 bio-oil types were produced and were labeled by the pretreatment torrefaction temperature (T100, T225, T250, or T275), pyrolysis heating rate (fast pyrolysis oil: FPO, or slow pyrolysis oil: SPO), and catalytic upgrading temperature (U400, U450, or U500). Each process condition was run in triplicate for a total of 96 samples.

Intermediate bio-oils produced from pyrolysis (FPO and SPO) and torrefaction followed by pyrolysis (SPO and FPO T225, T250, and T275) were also analyzed to determine the effect of torrefaction on intermediate bio-oil characteristics.

Product yield (% w/w) for each step including torrefaction, pyrolysis and catalytic cracking was determined as the weight change of the collection vessel divided by feedstock input. Phase yield, oily and aqueous, was determined by weighing gravity separated fractions. The combined yield of catalytic cracking byproducts including tar, catalyst coke, and reactor char was quantified by measuring the change in weight of the catalytic cracking reactor. Yields of individual byproduct components, i.e. coke, tar and char (by difference), were also determined.

Tar was considered to be the toluene/acetone/methanol-soluble material adhered to the catalyst and was quantified by washing the catalyst with a solvent mixture containing equal parts toluene, acetone, and methanol (TAM) after catalytic runs, drying the catalyst, and measuring the change in mass. Catalyst coke formation was determined by heating the washed catalyst in a thermogravimetric analyzer (TGA) to 650° C. under oxygen flow. The change in mass of catalyst was assumed to be due to the complete combustion of coke. The weight of reactor char was then determined as the difference between reactor weight change and combined coke and tar weight. All yields were calculated relative to dry pine chips feedstock unless otherwise noted.

Biomass torrefaction was proposed to improve the yield, quality, stability, and catalytic treatability of slow and fast pyrolysis oils. Torrefaction reduced the total liquid yield of bio-oil and increased solid yield upon pyrolysis. The torrefied feedstock exhibited increased carbon content and heating value. Significantly, torrefaction at 275° C. minimized reactor char, catalyst coke and tar. Coke yield indicated a significant increase dependent on the concentration of acetic acid, formic acid, and furfural, compounds that were reduced in concentration in bio-oils obtained from torrefied feedstock, most significantly at 275° C. Catalyst effectiveness for both liquid and BTEX production was improved with increasing torrefaction temperature relative to the control. Both effectiveness and BTEX concentration were highest in liquid product derived from feedstock torrefied at 275° C.

One aspect of the disclosure, therefore, encompasses embodiments of a method for reducing coke deposition on a catalyst used in cracking of a pyrolysis oil vapor, the method comprising: (a) subjecting a biomass to torrefaction; (b) pyrolyzing the torrefaction-treated biomass, thereby generating a heated pyrolysis oil vapor; (c) catalytically esterifying the heated pyrolysis oil vapor or components thereof, thereby providing a heated pyrolysis oil vapor having a reduced acid and aldehyde content compared to a heated pyrolysis oil vapor not catalytically esterified; and (d) cracking the catalytically esterified heated pyrolysis oil vapor, thereby generating a bio-oil, wherein said cracking step comprises contacting the heated pyrolysis oil vapor with a second catalyst, and wherein said catalyst accumulates a reduced coke deposition compared to when the heated pyrolysis oil vapor is generated from a biomass not treated with torrefaction.

In embodiments of this aspect of the disclosure, the heated pyrolysis oil vapor can be contacted with an aqueous composition comprising at least one alcohol and a first catalyst selected to catalyze the esterification of at least one component of the heated pyrolysis oil vapor.

In embodiments of this aspect of the disclosure, the at least one alcohol can be a primary alcohol.

In embodiments of this aspect of the disclosure, the at least one alcohol can be methanol, ethanol, or a combination thereof.

In embodiments of this aspect of the disclosure, the biomass can comprise lignocellulose.

In embodiments of this aspect of the disclosure, the first catalyst, the second catalyst, or the first and the second catalysts is a solid acid catalyst.

In embodiments of this aspect of the disclosure, the catalyst is a zeolite-based catalyst.

In embodiments of this aspect of the disclosure, the step (a) can comprise heating the biomass at a temperature of between about 100° C. to about 300° C. in an inert gas.

In embodiments of this aspect of the disclosure, the pyrolysis of step (b) can be fast pyrolysis.

In embodiments of this aspect of the disclosure, the step (b) can further comprise fractionating the heated pyrolysis oil vapor into an aqueous phase and a non-aqueous phase by condensing the heated pyrolysis oil vapor and providing the non-aqueous phase for the cracking step (c).

Another aspect of the disclosure encompasses embodiments of a method of generating a bio-oil from a biomass, the method comprising: (a) subjecting a biomass to torrefaction, wherein the torrefaction comprises heating the biomass at a temperature of between about 100° C. to about 300° C. in an inert gas; (b) pyrolyzing the torrefaction-treated biomass by fast pyrolysis, thereby generating a heated pyrolysis oil vapor; (c) catalytically esterifying the heated pyrolysis oil vapor or components thereof, thereby providing a heated pyrolysis oil vapor having a reduced acid and aldehyde content compared to a heated pyrolysis oil vapor not catalytically esterified, wherein the heated pyrolysis oil vapor from step (b) is contacted with an aqueous composition comprising at least one alcohol and a first catalyst selected to catalyze the esterification of at least one component of the heated pyrolysis oil vapor; and (d) cracking the catalytically esterified heated pyrolysis oil vapor, thereby generating a bio-oil, wherein said cracking step comprises contacting the heated pyrolysis oil vapor with a second catalyst, and wherein said catalyst accumulates a reduced coke deposition compared to when the heated pyrolysis oil vapor is generated from a biomass not treated with torrefaction.

In embodiments of this aspect of the disclosure, the at least one alcohol can be a primary alcohol.

In embodiments of this aspect of the disclosure, the at least one alcohol can be methanol, ethanol, or a combination thereof.

In embodiments of this aspect of the disclosure, the biomass can comprise lignocellulose.

In embodiments of this aspect of the disclosure, the first catalyst, the second catalyst, or the first and the second catalysts can be a solid acid catalyst.

In embodiments of this aspect of the disclosure, the first catalyst, the second catalyst, or the first and the second catalysts is a zeolite-based catalyst.

In embodiments of this aspect of the disclosure, the step (b) can further comprises fractionating the heated pyrolysis oil vapor into an aqueous phase and a non-aqueous phase by condensing the heated pyrolysis oil vapor and providing the non-aqueous phase for the cracking step (c).

In embodiments of this aspect of the disclosure, the product of the catalytic esterification can comprise an ester selected from the group consisting of: ethyl acetate, ethyl formate, and ethyl levulinate.

Yet another aspect of the disclosure encompasses embodiments of a bio-oil product generated by the process according to the disclosure.

Still another aspect of the disclosure encompasses embodiments of a system for generating a pyrolysis bio-oil product according to the process of the disclosure, the system comprising a torrefaction unit, a pyrolysis unit, a catalytic esterification unit, a catalytic cracking unit, and optionally a condensation unit.

The specific examples below are to be construed as merely illustrative, and not limiting of the remainder of the disclosure in any way whatsoever. Without further elaboration, it is believed that one skilled in the art can, based on the description herein, utilize the present disclosure to its fullest extent. All publications recited herein are hereby incorporated by reference in their entirety.

It should be emphasized that the embodiments of the present disclosure, particularly, any "preferred" embodiments, are merely possible examples of the implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure, and the present disclosure and protected by the following claims.

The following examples are put forth so as to provide those of ordinary skill in the art with a complete disclosure and description of how to perform the methods and use the compositions and compounds disclosed and claimed herein. Efforts have been made to ensure accuracy with respect to numbers (e.g., amounts, temperature, etc.), but some errors and deviations should be accounted for. Unless indicated otherwise, parts are parts by weight, temperature is in ° C., and pressure is at or near atmospheric. Standard temperature and pressure are defined as 20° C. and 1 atmosphere.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include ±1%, ±2%, ±3%, ±4%, ±5%, ±6%, ±7%, ±8%, ±9%, or ±10%, or more of the numerical value(s) being modified.

EXAMPLES

Example 1

A multi-step process was used to generate bio-oil with characteristics similar to conventional fuels. Steps included feedstock pretreatment (via torrefaction), pyrolysis (fast and slow heating rates), and secondary catalytic cracking. Further included is a catalyzed step for the esterification of acids and the formation of platform compounds such as ethyl levulinate from levuglucosan. Torrefaction was performed in a pilot scale (500 kg per batch) rotating kiln torrefaction unit. Torrefied feedstock was pyrolyzed under fast pyrolysis conditions (less than 5 s reaction time) in a continuous flow fluidized bed pyrolysis unit (FBPU). Slow pyrolysis was performed in a batch slow pyrolysis unit (BSPU). For catalytic cracking, a fixed-bed plug flow reactor (PFR) unit was used to process bio-oil generated via the fast pyrolysis of pine chip (PC) or torrefied pine chip (TPC) biomass.

Loblolly pine biomass was supplied in the form of delimbed and debarked logs. Logs were then cut into sections prior to being chipped. Material was then sorted power screener with a 0.64 cm screen to collect reject material. Particles larger than 5 cm were hand removed. Chipped biomass was left to air dry in a covered, open shed for 6 months prior to further processing.

A one-step process involved pyrolysis of oven-dried (105° C. for 4 h) pine chips biomass at 500° C. in the FBPU (heating rate greater than 100° C. $s^{-1}$) or the BSPU (8° C. $min^{-1}$ heating rate). Prior to fast pyrolysis, biomass particle size was reduced in a hammer mill to between about 1 to about 2 mm. The FBPU consisted of a volumetric auger feeder, a fluidized bed riser reactor (61 cm long by 4.75 cm internal diameter), two sequential cyclonic solid separators, a hot gas filter (5 μm pore size), and a shell and tube condensing system maintained at 20° C. Biomass feed was supplied at approximately 500 g $h^{-1}$ to the reactor (maintained at 500° C.) where the feed contacted hot fluidized quartz sand (0.255 mm mean diameter) in 20 L $min^{-1}$ preheated nitrogen. The volumetric biomass feeder was weighed prior to and after runs to determine the total amount of biomass fed for yield calculations. The batch slow pyrolysis reactor used was a cubical stainless container with the dimensions 20 cm high×20 cm wide×20 deep cm. Two 1.3 cm ports allowed the introduction of inert gas and the removal of evolved gases and vapors. For slow pyrolysis runs, approximately 3 kg of dry pine chips were placed in the reactor, and the reactor was placed in a single set point electric furnace. A low heating rate (8° C. $min^{-1}$) was applied until the reactor reached a final internal temperature of 500° C., and evolved vapors were condensed in an ice bath vapor trap. The two-phase liquid obtained was separated in a separatory funnel. The heavier, non-aqueous lower phase was considered the product. Subsamples of condensed bio-oil from fast and slow pyrolysis (heavier organic phase) were analyzed, while the remaining sample was used in the subsequent catalytic cracking process, the as-named two-step process described below.

In the process, previously produced and phase-separated (slow pyrolysis only) bio-oil was injected continuously into the PFR maintained at 400° C., 450° C., or 500° C. using a tube furnace. The PFR consisted of a 2.4 cm internal diameter reactor with a 38 cm length. A 15 cm pre-heater section was incorporated into the reactor to ensure that bio-oil was in vapor phase prior to crossing the 10 g catalyst bed (28.5 $cm^3$) that was held in place by stainless steel screens and quartz wool above and below the bed. Bio-oil was pumped using a peristaltic pump that maintained a feed rate of 1.5 $cm^3$ $min^{-1}$ (approximating to 100 g $h^{-1}$ at an average bio-oil feedstock density of 1.1 g $cm^{-3}$) corresponding to a weight hourly space velocity (WHSV, $h^{-1}$) of 10 $h^{-1}$. WHSV was calculated as the mass flow rate (g $h^{-1}$) of liquid feed divided by the catalyst mass (g). These reaction conditions corresponded to a liquid hourly space velocity (LHSV=reactant liquid flow rate [$cm^3$ $h^{-1}$]/reactor volume [$cm^3$]) of 3.2 $h^{-1}$. Catalyst to oil ratio (C/O, weight of catalyst divided by the weight of oil fed) ranged from 0.34 to 0.65. Catalyst contact time (3600/(WHSV·C/O) thus ranged from 554 to 1058 s. Given a carrier gas flow rate of 50 $cm^3$ $min^{-1}$, gas phase residence time in the catalytic zone (V=28.5 $cm^3$) was approximately 34 s.

Example 2

The catalyst, HZSM-5, was produced by calcining $NH_4$-ZSM-5 (Zeolyst International, CBV 5524 G) at 550° C. for 4 h in air to produce the hydrogen form, H-ZSM-5, resulting in stronger acid pore sites. The $NH_4$-ZSM-5 catalyst was received from the manufacturer as a fine powder. The pH was measured by mixing catalyst in water at a 50:50 ratio and then measuring the pH of the water using a standard pH probe. As a result of the calcining process, the pH was reduced from 4.98 to 3.06. To minimize the pressure drop across the catalyst bed, the catalyst was granulated by mixing with water, drying, crumbling, and sieving to the desired size of approximately 2 mm to about 4 mm. The catalyst powder had published values of 425 $m^2$ $g^{-1}$, 5 μm, and 50 for surface area, particle size and $SiO_2/Al_2O_3$ ratio, respectively. After calcination, drying, and granulation, catalyst surface characteristics (surface area, average pore radius, and pore volume) were determined using a surface area analyzer by measuring nitrogen adsorption/desorption isotherms. The adsorption/desorption isotherms were obtained at −196° C. (77° K) with the Brunauer-Emmett-Teller (BET) surface area calculated from the linear portion of the multipoint BET plot. The micropore volume and external surface area were evaluated using the t-plot method, and the pore size distribution was obtained using the Brunauer-Joyner-Halenda (BJH) model. Measured surface area was 345 $m^2$ $g^{-1}$, average pore radius was 10.8 Å, and pore volume was 0.1851 $cm^3$ $g^{-1}$ for granulated and calcined catalyst.

Example 3

Product Characterization: Solid materials including biomass, torrefied biomass and pyrolysis char were subsampled and analyzed. Other solids generated during catalytic cracking including reactor char, catalyst coke, and tar were not analyzed compositionally, only quantified. The yield of non-condensable gas was determined by difference.

Feedstock and products were analyzed by an assortment of methods. Biomass feedstock was analyzed for proximate composition (moisture, volatiles, ash and fixed carbon), and elemental composition (CHNS-O). The initial quality of bio-oils was assessed by measuring CHNS-O and calculating molar $H/C_{eff}$ and O/C ratios which provide good indications of fuel applicability and the level of deoxygenation, respectively, as a result of secondary processing by catalytic cracking. $H/C_{eff}$ was calculated as follows:

$$\frac{H}{C_{eff}} = \frac{\text{mol H} - 2\times\text{mol O}}{\text{mol C}} \quad \text{(Eq. 1)}$$

Chemical composition was determined using calibrated GC-MS and HPLC methods. The calibrated GC-MS method was used to determine the concentration of proposed reactants including guaiacol (2-methoxyphenol), creosol (2-methoxy-4-methylphenol), and acetic acid and of products including benzene, toluene, ethylbenzene, and xylene (collectively, BTEX) products based on 6-point calibrations with pure compound mixtures with an internal standard, heptane. Upon calculating peak areas relative to heptane and using the calibration factors from the standard calibration curve, the concentration of BTEX and reactants in the product liquid was found for all samples from each process condition combination. Product yields of benzene, toluene, ethylbenzene, p-, m-, and o-xylene, total BTEX, and other non-BTEX compounds were found relative to the amount in the feed bio-oil. The conversion of guaiacol and creosol was also determined.

The HPLC system (Shimadzu) used to determine the concentrations (g $L^{-1}$) of major water-soluble compounds including levoglucosan, acetic acid, formic acid, 5-hydroxymethylfurfural, and furfural using a calibrated method. Aqueous samples for HPLC analysis were generated by mixing oily phase bio-oil with water at a 1:1 ratio, centrifuging the mixture, then taking a subsample of the upper aqueous phase for analysis.

Example 4

Catalyst Effectiveness: Catalyst effectiveness was determined as in Adjaye & Bakhshi (1995) *Fuel Processing Technol.* 45: 185-202, incorporated herein by reference in its entirety. The study defined $C_{eff}$ as the follows:

$$C_{eff} = Y_i S_i \quad \text{(Eq. 2)}$$

In equation 2, $Y_i$ is the yield of product, i, and is defined as:

$$Y_i(\text{wt }\%) = {}^{Product(g)}/_{Bio\text{-}oil\ Fed\ (g)} \quad \text{(Eq. 3)}$$

For this study, both the yield of upgraded bio-oil and the collective yield of BTEX compounds were used to indicate the catalyst effectiveness. In Eq. 2, S, is the selectivity and is calculated by:

$$S_i = \frac{\text{Desired Product (wt \%)}}{\text{Undesired Product (wt \%)}} \quad \text{(Eq. 4)}$$

$$= \frac{\text{Product (wt \%)}}{\text{(Char (wt \%) + Coke (wt \%) + Tar (wt \%) + Gas (wt \%))}} \quad \text{(Eq. 5)}$$

Reaction conditions that maximized $C_{eff}$ are optimal in the production of desired product from the catalytic cracking of bio-oil derived from the pyrolysis of torrefied biomass.

Example 5

Catalyst Characterization: After each catalytic process, a sub-sample of TAM-washed catalyst was taken for surface area analysis to determine how processing conditions affected the affected surface area, pore radius, and pore volume due to the formation of coke. The surface chemistry of the catalysts was compared prior to and after processing using temperature programmed desorption (TPD) of $NH_3$ in a Quantachome (Boyton Beach, FL, USA) Autosorb (Model 1-C) analyzer that was also used to measure surface area characteristics. The analyzer was equipped with a thermal conductivity detector (TCD) for detection of $NH_3$ during desorption. The intent was to show the change in acid strength and acid site density as a function of process conditions. Prior to adsorption, samples were degassed at 300° C. for 2 h then exposed to flowing $NH_3$ and heated to 500° C. at 20° C. $min^{-1}$. There was less change in catalyst surface area, volume, pore radius, and surface chemistry parameters in catalysts from upgrading runs using torrefied feedstock for bio-oil production relative to catalysts used to process bio-oils generated from non-torrefied feedstock.

Example 6

Statistical Design: The experiment was designed such that 3-way ANOVA could be used to determine the effects of these factors including torrefaction pretreatment temperature (4 levels at 100° C., 225° C., 250° C., and 275° C., denoted T100, T225, T250, and T275, respectively), pyrolysis heating rate (2 levels at 0.13 or 100° C. $s^{-1}$, denoted SP or FP for slow pyrolysis and fast pyrolysis), and catalytic cracking temperature (4 levels at 0° C., 400° C., 450° C., and 500° C., denoted as CTRL, U400, U450, and U500, respectively), on yields, product composition and quality, and catalyst properties. The null hypothesis for all analyses was that factors at any level had no effect on product yield, product composition, or catalyst characteristics. Rejection of the null hypothesis was concluded at p-values less than a level of significance, $\alpha=0.05$. The Holm-Sidak method of multiple comparisons was used to compare the effects of levels for each factor.

Example 7

Effect of torrefaction on solid feedstock; Yields of solid material at T100, T225, T250, and T275 were 86.0, 71.2, 69.7, and 55.7% (w/w of air-dried pine chips biomass), respectively, after a hold time of 20 min as shown in Table 1. As expected, solid product yield significantly ($p<0.001$) decreased with increasing torrefaction temperature as a result of greater volatilization. Volatile matter remaining was lower for pine chips having undergone higher temperature torrefaction (Table 2). At the same time, fixed carbon and elemental carbon in the solid increased from 17.9 to 27.5% (w/w) and from 46.9 to 53.3% (w/w), respectively for pine chips versus pine chips T275. Oxygen content was reduced from 46.3 to 39.9% (w/w).

Example 8

Effect of torrefaction on pyrolysis and catalytic cracking product yield: With less volatile matter remaining, liquid and char yields from pyrolysis of torrefied material showed a significant linear decrease and increase, respectively, with increasing pretreatment temperature ($p<0.001$). Table 2 provides yield results for the pyrolysis processes relative to pretreated biomass.

TABLE 2

Yield of material after pretreatment and pyrolysis.

| | Yield (% w/w Pretreated Biomass) | | | | | | | |
|---|---|---|---|---|---|---|---|---|
| | Fast Pyrolysis | | | | Slow Pyrolysis | | | |
| Fraction | 100° C. | 225° C. | 250° C. | 275° C. | 100° C. | 225° C. | 250° C. | 275° C. |
| Oil | 22.4 | 13.8 | 13.8 | 11.0 | 8.5 | 8.1 | 7.4 | 7.8 |
| Aqu | 0.0 | 0.0 | 0.0 | 0.0 | 34.1 | 35.1 | 34.3 | 27.0 |
| Char | 21.0 | 17.8 | 31.1 | 66.5 | 29.6 | 29.4 | 30.2 | 37.8 |
| Gas | 56.6 | 68.4 | 55.1 | 22.4 | 27.3 | 26.7 | 26.1 | 26.1 |

Aqueous phase and oily phase liquid showed a significant inverse relationship with pre-treatment temperature (i.e. liquid yield was reduced with increasing temperature). Concurrently, non-condensable gas and solid yields increased significantly with increasing pretreatment temperature.

FIG. 1 illustrates liquid yield versus dry pine chips. For both fast and slow pyrolysis, there was a linear decrease in yield for oily phase liquid with increasing pre-treatment temperature. Despite lower oily phase liquid yield, positive effects on intermediate bio-oil quality were expected due to reduced concentrations of reactive compounds including organic acids (formic, acetic and lactic), aldehydes (furfural, acetaldehyde), and ketones as indicated by Prins et al., (2006) *J. Analytical Applied Pyrolysis* 77(1): 35-40.

Figure 2A:
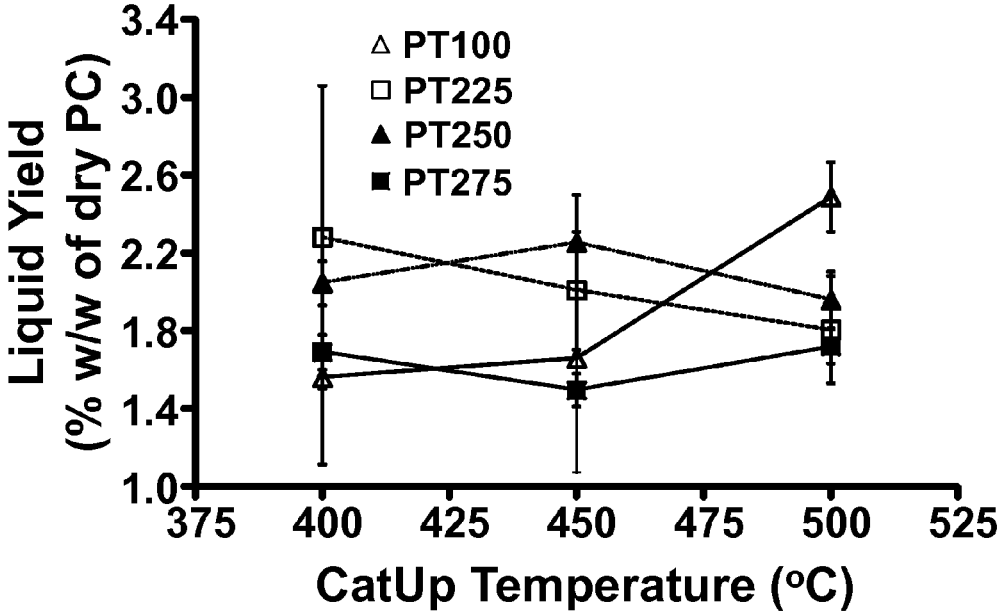
FIGS. 2A-2D is a series of graphs illustrating the yield (% w/w of dry pine chips) of liquid product (FIGS. 2A and 2B) and byproduct tar (FIGS. 2C and 2D) from catalytic cracking of slow pyrolysis oil (SPO) (FIGS. 2A and 2D) and fast pyrolysis oil (FPO) (FIGS. 2B and 2D) derived from pine chips pretreated at 100° C., 225° C., 250° C., and 275° C. Error bars indicate the 95% confidence interval.
Figure 2B:
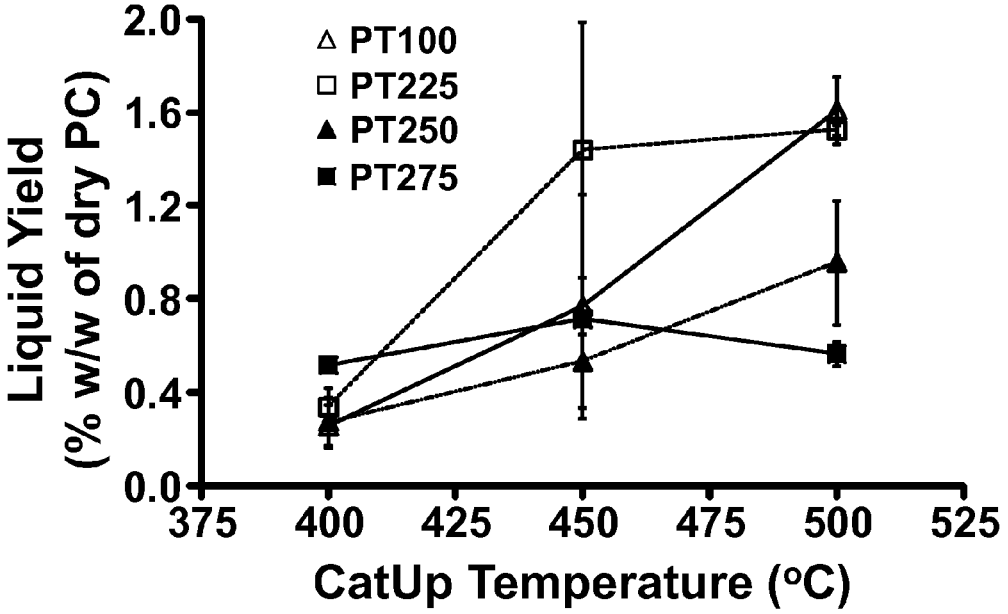
Figure 2C:
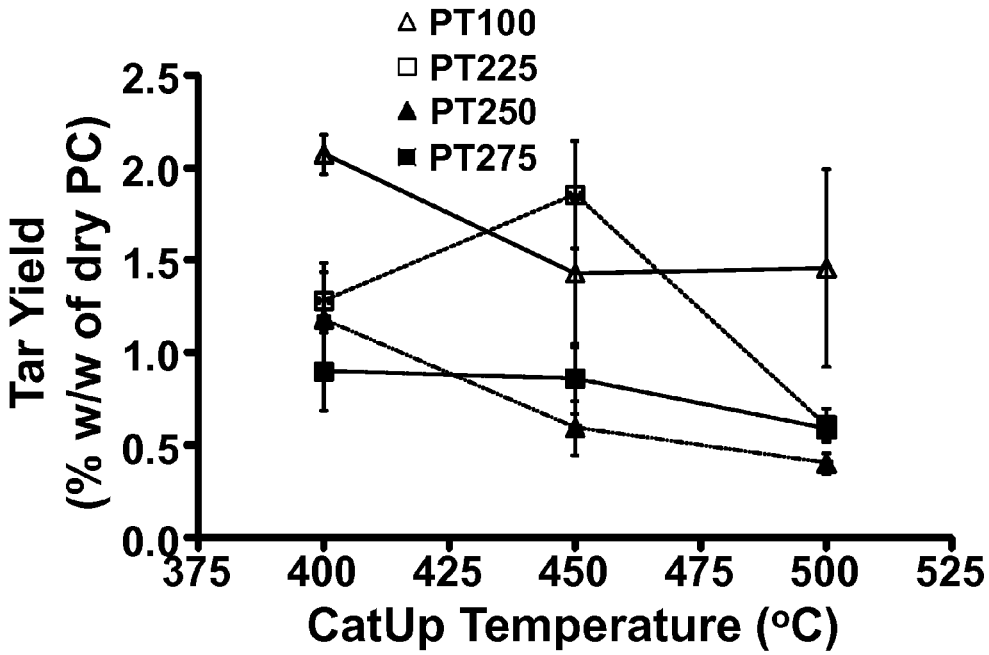
Figure 2D:
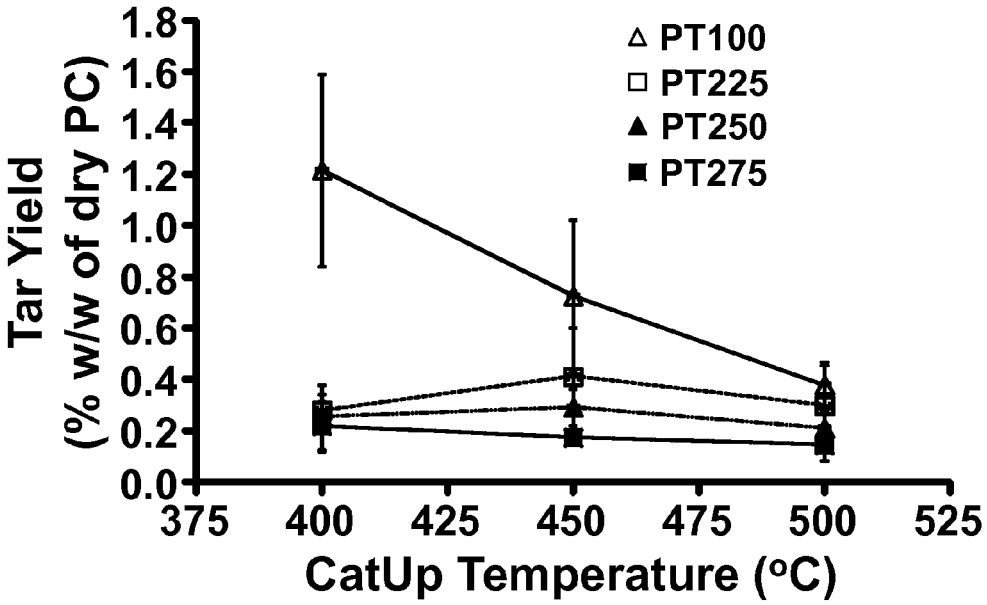

Torrefaction had a significant effect on the yield of all products of catalytic cracking including liquid product (oily and aqueous), non-condensable gas, catalyst coke, catalyst tar, and reactor char. Catalytic cracking for all combinations of pretreatment and pyrolysis generated a two-phase product including an aqueous phase (greater than 80% water) and a heavier, organic phase (i.e. "oily phase") considered to be the ultimate product. Liquid product (oily phase) yield (w/w of dry pine chips as shown in FIGS. 2A and 2B) decreased significantly with increasing pretreatment temperature for two temperature comparisons: T225 versus T275 (0.45% difference) and T100 versus T275 (0.27% difference). Although the differences in percentage yield are small, they are significant relative to the overall yields which ranged from 0.2 to 3.1%. All other pretreatment temperature comparisons were statistically insignificant.

Liquid product yield for SP-derived oils (SPOs) (1.9% w/w of dry pine chips) was significantly higher than for just FP-derived oils (FPOs) (0.79%). Gas yield significantly increased with increasing pretreatment temperature for all temperature comparisons. Tar yield also significantly decreased with increasing temperature for all pretreatment temperature comparisons except for T250 versus T275.

Figure 3A:
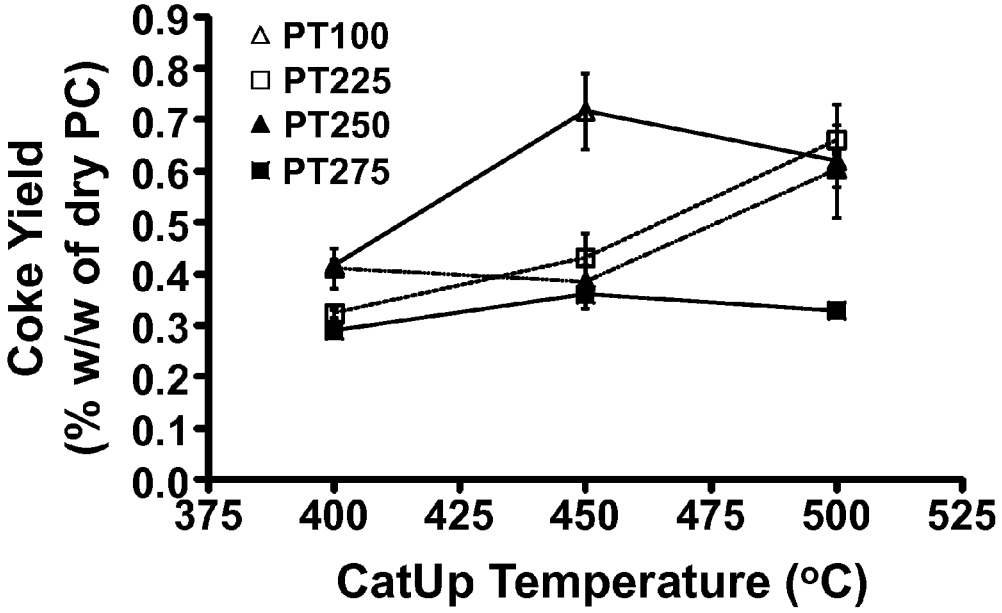
FIGS. 3A-3D is a series of graphs illustrating the yield (% w/w of dry pine chips) of solid products including catalyst coke (FIGS. 3A and 3B) and reactor char (FIGS. 3C and 3D) from catalytic cracking of SPO (FIGS. 3A and 3C) and FPO (FIGS. 3B and 3D) derived from pine chips pretreated at 100° C., 225° C., 250° C., and 275° C. Error bars indicate the 95% confidence interval.
Figure 3B:
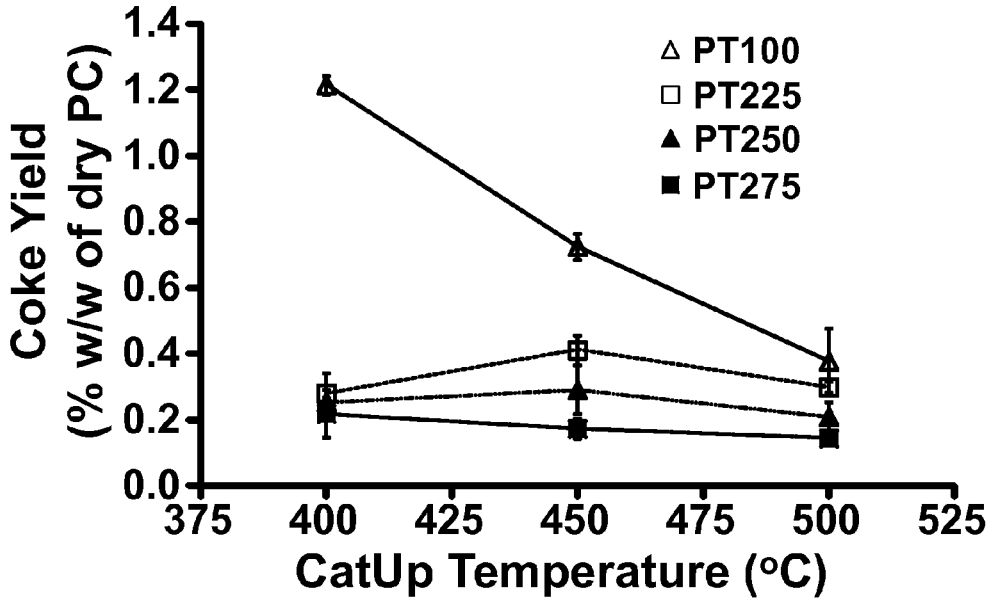
Figure 3C:
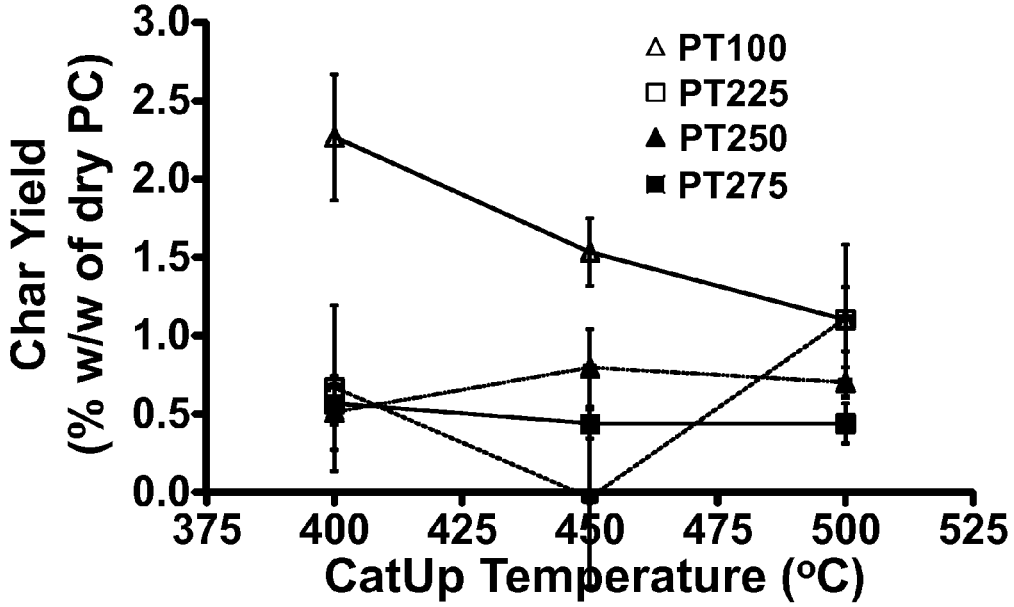
Figure 3D:
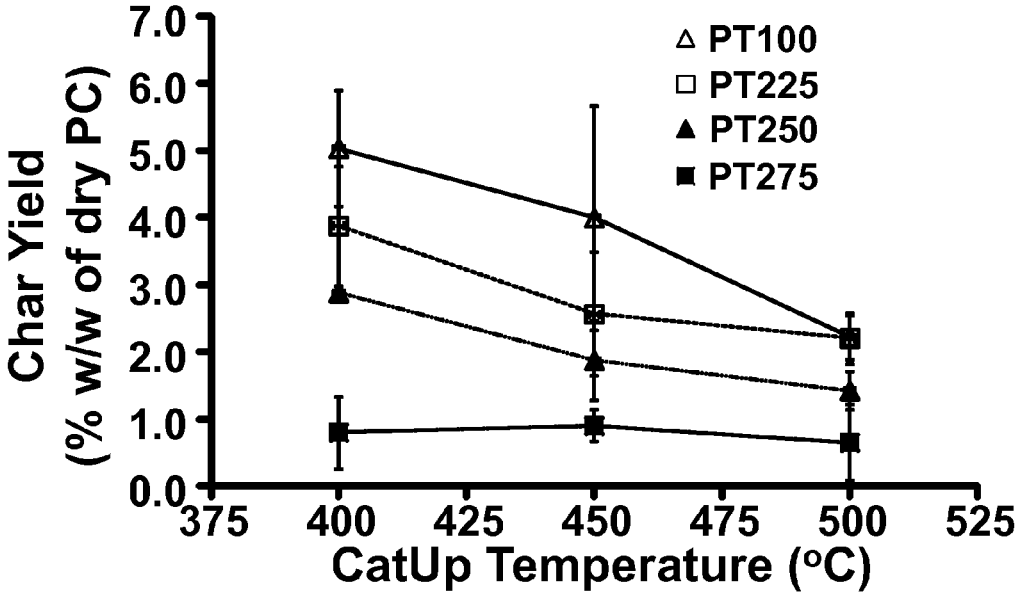
Figure 4A:
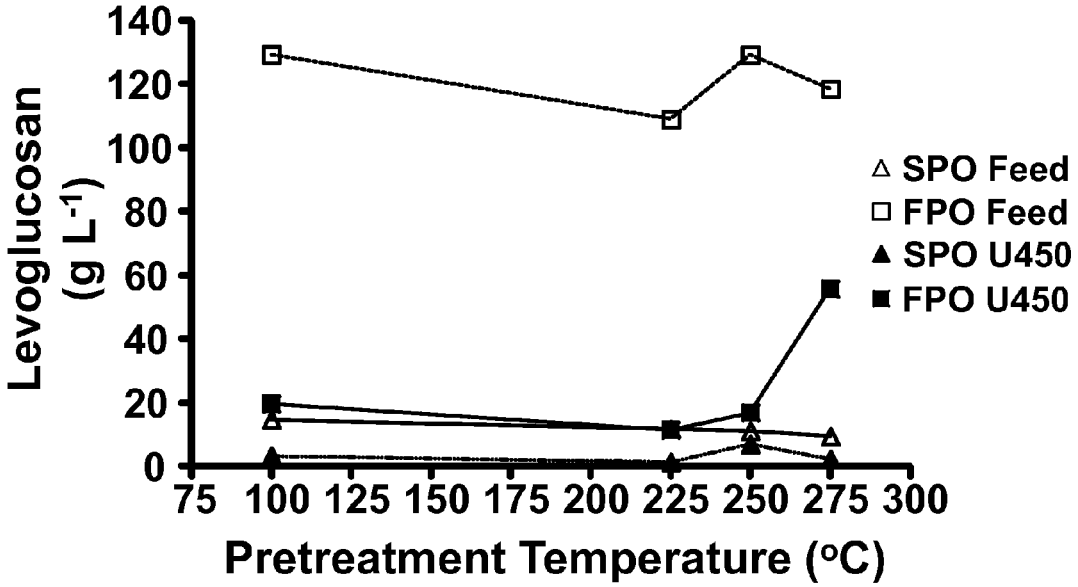
FIGS. 4A-4E is a series of graphs illustrating the concentrations (g $L^{-1}$) of components in bio-oil generated from feedstock pretreated at 100° C., 225° C., 250° C., and 275° C. prior to and after catalytic cracking, as determined by HPLC.
Figure 4B:
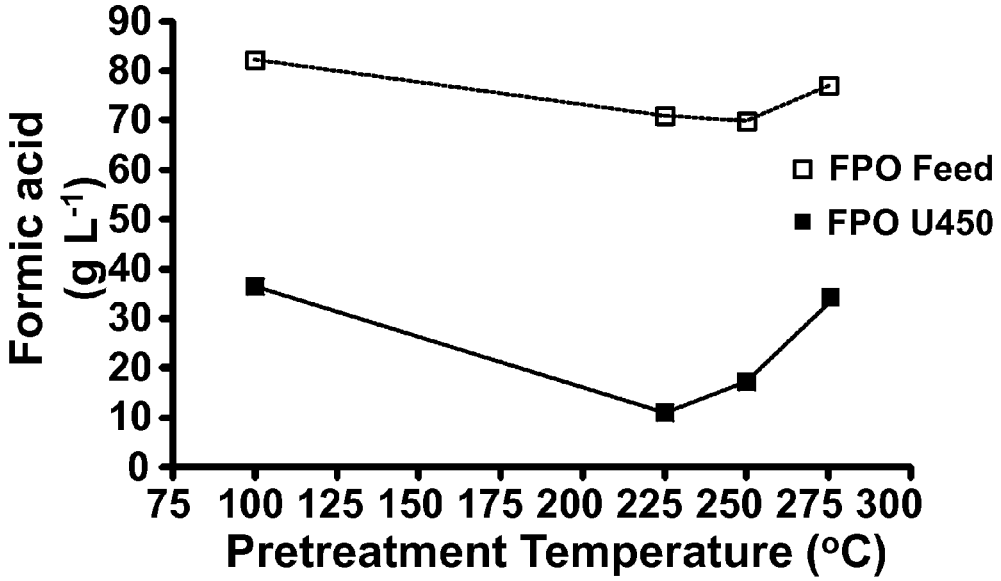
Figure 4C:
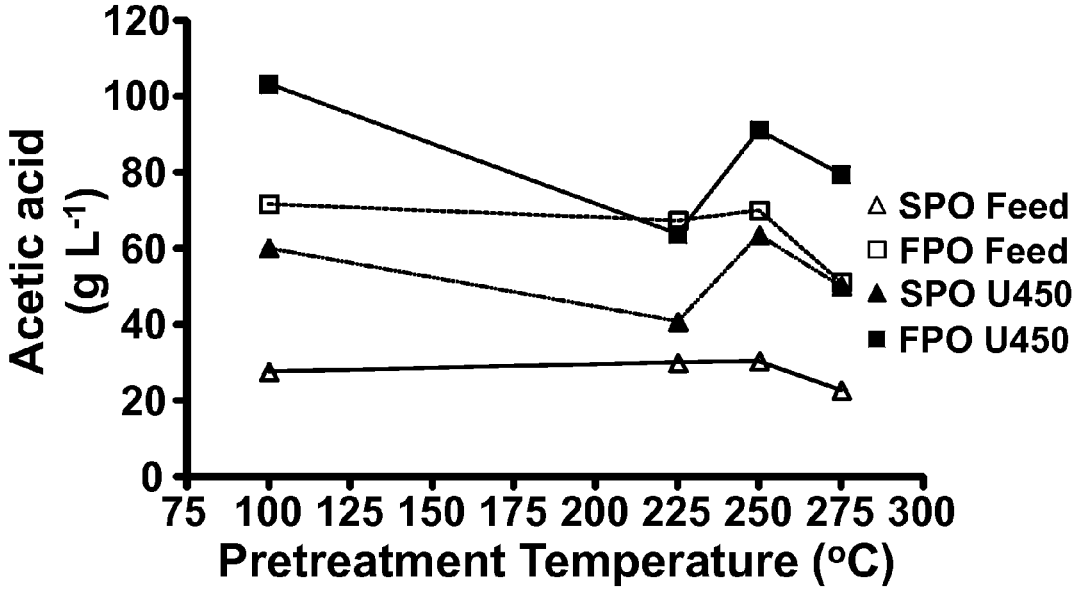
Figure 4D:
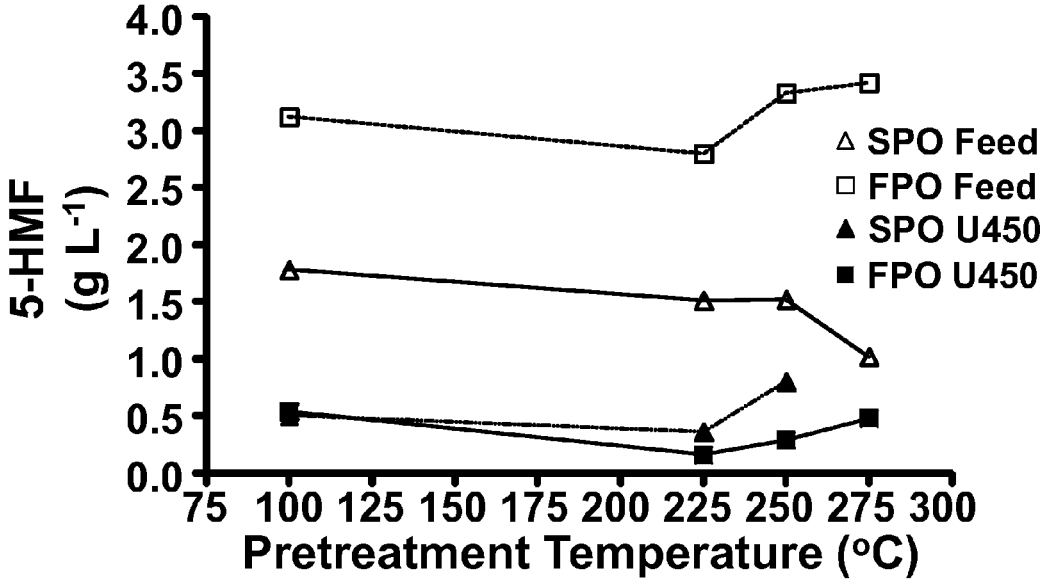
Figure 4E:
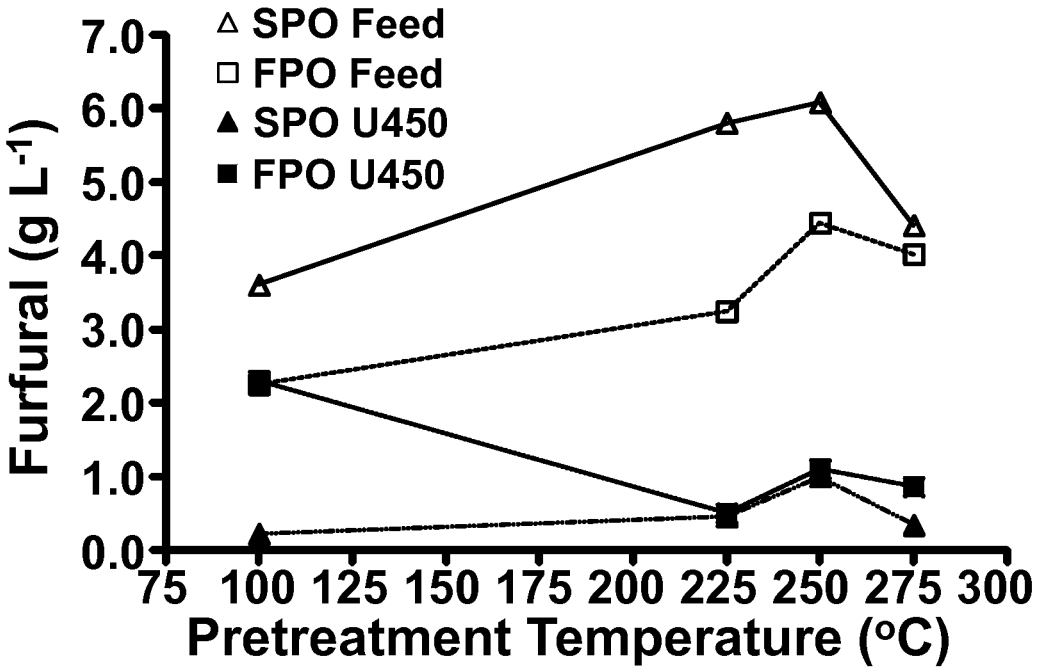

There was a significant reduction in catalyst coke (see FIGS. 3A and 3B) with increasing pretreatment temperature for all temperature comparisons. In one example for SPO upgrading (FIG. 3A), the reduction in coke (% w/w of feed) was 28.5% relative to the respective control (SP T250 U450 versus SP T100 U450). For FPO processing, the greatest reduction in coke was 34.9% (FP T275 U400 versus FP T100 U400). Thus all torrefaction temperatures reduced coke and tar relative to T100 controls. Increasing torrefaction temperature also significantly reduced reactor char production for all temperature comparisons except for T225 versus T250. For SPO, the largest reduction in char formation was 61.2% for SP T250 U400 versus SP T100 U400. For FPO, the largest reduction was 57.8% for FP T225 U400 versus FP T100 U400.

Accordingly, torrefaction resulted in the reduction of unwanted byproducts including tar (60.3% reduction for best case), char (76.5% reduction for best case), and coke (64.9% reduction for best case). Product liquid yield was largely unaffected by torrefaction although gas yield increased with torrefaction due to enhanced conversion of byproducts. If byproduct minimization is desired, results showed that pretreatment at 275° C. was the best temperature to utilize, while pretreatment temperatures at 100° C., 225° C., and 250° C. maximized product liquid formation.

Example 9

Effect of coke precursor concentration on coke yield: FIGS. 4A-4E show the concentrations of several reactants, including levoglucosan (FIG. 4A), formic acid (FIG. 4B), acetic acid (FIG. 4C), 5-hydroxymethylfurfural (5-HMF, 4D), and furfural (4E) before and after catalytic processing at U450. The pyrolysis heating rate was a highly significant predictor of each of these components' concentration. For each reactant except furfural, the concentration was higher in FPO feed, compared to the SPO feed. Additionally, the concentration of furfural increased with the torrefaction temperature (p=0.042).

The effect of the concentration of these components in SPO and FPO prior to upgrading in addition to the pyrolysis heating rate and the torrefaction temperature on the yield of coke upon catalytic processing was determined using backward stepwise regression. Analysis indicated that torrefaction at 275° C. reduced acetic and formic acid levels in the generated bio-oil. In addition the concentrations of levoglucosan, formic acid, acetic acid, and furfural were highly significant ($R^2$=0.992, p=0.002) predictors of catalyst coke.

Levoglucosan indicated a positive correlation (reduction) with coke, while all others showed a negative correlation (increase). This observation indicates that formic acid, acetic acid and furfural are coke promoters or precursors and that minimizing the concentration of these in bio-oil feedstock reduces coke formation, an observation that was most apparent at a torrefaction temperature of 275° C. The increased concentration of formic acid, acetic acid and furfural in FPO explains the increased coke yield for FPO versus SPO processing.

Example 10

Effect of process conditions on CHNS-O, $H/C_{eff}$, O/C, and the higher heating value HHV: Pretreatment temperature, pyrolysis heating rate and catalytic cracking temperature significantly affected elemental carbon (C), nitrogen (N), and oxygen (O) as well as the O/C ratio and HHV. Elemental H was affected significantly only by catalytic upgrading temperature. $H/C_{eff}$ was significantly affected by both pyrolysis heating rate and catalytic upgrading temperature.

TABLE 3

Characteristics of product bio-oil generated via pretreatment, slow pyrolysis and catalytic cracking using pretreated pine chips as the slow pyrolysis feedstock.

| | 100 | | | | 225 | | | |
|---|---|---|---|---|---|---|---|---|
| Parameter | CTRL | 400 | 450 | 500 | CTRL | 400 | 450 | 500 |
| C | 63.4 | 67.9 | 70.1 | 69.0 | 60.5 | 66.4 | 70.8 | 72.4 |
| H | 6.3 | 7.8 | 7.9 | 7.6 | 6.5 | 7.1 | 7.9 | 7.7 |
| N | 0.2 | 0.1 | 0.0 | 0.0 | 0.7 | 0.3 | 0.4 | 0.5 |
| S | 0.0 | 0.0 | 0.0 | 0.0 | 0.0 | 0.0 | 0.0 | 0.0 |
| O[a] | 30.1 | 24.3 | 23.4 | 22.2 | 32.4 | 26.3 | 20.9 | 19.8 |
| $H/C_{eff}$ | 0.5 | 0.8 | 0.8 | 0.8 | 0.5 | 0.7 | 0.9 | 0.9 |
| O/C | 0.4 | 0.3 | 0.3 | 0.2 | 0.4 | 0.3 | 0.2 | 0.2 |
| HHV ($MJ\ kg^{-1}$)[b] | 26.4 | 30.3 | 31.3 | 30.8 | 25.4 | 28.8 | 31.9 | 32.4 |
| OOT (° C.) | 161.5 | 145.5 | 160.5 | 163.9 | 157.1 | 145.5 | 160.5 | 156.5 |

| | 250 | | | | 275 | | | |
|---|---|---|---|---|---|---|---|---|
| Parameter | CTRL | 400 | 450 | 500 | CTRL | 400 | 450 | 550 |
| C | 60.8 | 66.8 | 67.0 | 72.3 | 62.4 | 68.4 | 68.0 | 70.0 |
| H | 6.5 | 7.6 | 7.4 | 7.7 | 6.2 | 7.4 | 7.7 | 7.9 |
| N | 0.5 | 0.2 | 0.0 | 0.2 | 0.2 | 0.2 | 0.1 | 0.0 |
| S | 0.0 | 0.0 | 0.0 | 0.0 | 0.0 | 0.0 | 0.0 | 0.0 |
| O[a] | 32.2 | 25.5 | 25.6 | 19.7 | 31.2 | 24.1 | 24.2 | 22.1 |
| $H/C_{eff}$ | 0.5 | 0.8 | 0.8 | 0.9 | 0.4 | 0.8 | 0.8 | 0.9 |
| O/C | 0.4 | 0.3 | 0.3 | 0.2 | 0.4 | 0.3 | 0.3 | 0.2 |
| HHV ($MJ\ kg^{-1}$)[b] | 25.5 | 29.6 | 29.5 | 32.3 | 25.8 | 30.0 | 30.2 | 31.4 |
| OOT (° C.) | 159.4 | 140.9 | 151.4 | 156.6 | 158.0 | 153.0 | 154.5 | 160.4 |

[a]Calculated by difference.

[b]Calculated according to Channiwala & Parikh (2002) *Fuel* 81, 1051-1063, incorporated herein by reference in its entirety.

TABLE 4

Characteristics of product bio-oil generated via pretreatment, fast pyrolysis and catalytic cracking using pretreated pine chips as the fast pyrolysis feedstock.

| | 100 | | | | 225 | | | |
|---|---|---|---|---|---|---|---|---|
| Parameter | CTRL | 400 | 450 | 500 | CTRL | 400 | 450 | 500 |
| C | 35.1 | 71.6 | 74.2 | 80.4 | 35.8 | 39.7 | 57.2 | 71.9 |
| H | 6.5 | 7.9 | 7.8 | 8.1 | 6.2 | 8.8 | 7.9 | 7.0 |
| N | 0.0 | 0.0 | 0.0 | 0.0 | 0.1 | 0.0 | 0.0 | 0.1 |
| S | 0.0 | 0.0 | 0.0 | 0.0 | 0.0 | 0.0 | 0.0 | 0.0 |
| O[a] | 58.4 | 33.1 | 18.0 | 11.6 | 57.9 | 53.6 | 34.9 | 21.1 |
| $H/C_{eff}$ | −0.3 | 0.6 | 0.9 | 1.0 | −0.3 | 0.6 | 0.7 | 0.7 |
| O/C | 1.3 | 0.3 | 0.2 | 0.1 | 1.2 | 1.0 | 0.5 | 0.2 |
| HHV ($MJ\ kg^{-1}$)[b] | 13.9 | 30.9 | 33.2 | 36.4 | 13.8 | 18.7 | 25.7 | 31.1 |
| OOT (° C.) | 168.6 | 161.0 | 160.7 | 159.7 | 135.8 | 145.9 | 157.7 | 163.3 |

| | 250 | | | | 275 | | | |
|---|---|---|---|---|---|---|---|---|
| Parameter | CTRL | 400 | 450 | 500 | CTRL | 400 | 450 | 500 |
| C | 39.3 | 71.5 | 72.7 | 71.1 | 42.0 | 75.6 | 72.0 | 80.1 |
| H | 6.1 | 7.5 | 7.7 | 7.7 | 6.0 | 7.4 | 7.6 | 8.0 |
| N | 0.2 | 0.0 | 0.0 | 0.0 | 0.1 | 0.0 | 0.0 | 0.0 |
| S | 0.0 | 0.0 | 0.0 | 0.0 | 0.0 | 0.0 | 0.0 | 0.0 |
| O[a] | 53.8 | 32.0 | 19.6 | 20.7 | 52.0 | 18.8 | 20.4 | 11.9 |
| $H/C_{eff}$ | −0.2 | 0.6 | 0.9 | 0.9 | −0.2 | 0.8 | 0.8 | 1.0 |
| O/C | 1.0 | 0.3 | 0.2 | 0.2 | 0.9 | 0.2 | 0.2 | 0.1 |
| HHV ($MJ\ kg^{-1}$)[b] | 15.4 | 30.5 | 32.5 | 31.7 | 16.3 | 33.2 | 32.0 | 36.2 |

TABLE 4-continued

Characteristics of product bio-oil generated via pretreatment, fast pyrolysis and catalytic cracking using pretreated pine chips as the fast pyrolysis feedstock.

| | | | | | | | | |
|---|---|---|---|---|---|---|---|---|
| OOT (° C.) | 130.0 | 162.2 | 154.9 | 164.9 | 126.4 | 149.7 | 151.2 | 149.1 |

[a]Calculated by difference.

[b]Calculated according to Channiwala & Parikh (2002) *Fuel* 81, 1051-1063, incorporated herein by reference in its entirety.

The carbon content significantly increased with increasing catalytic cracking temperature, and was higher for SPO than for FPO feedstock. However, for upgraded oils, the carbon content for FPO-derived product was significantly higher. The FPO T275 U500 product indicated the highest C-content at 80.1%. The carbon content for T275, T250, and T100 were all higher than for T225. In both SPO- and FPO-derived oils, the control had a significantly lower $H/C_{eff}$ ratio than did upgraded oils.

Figure 5A:
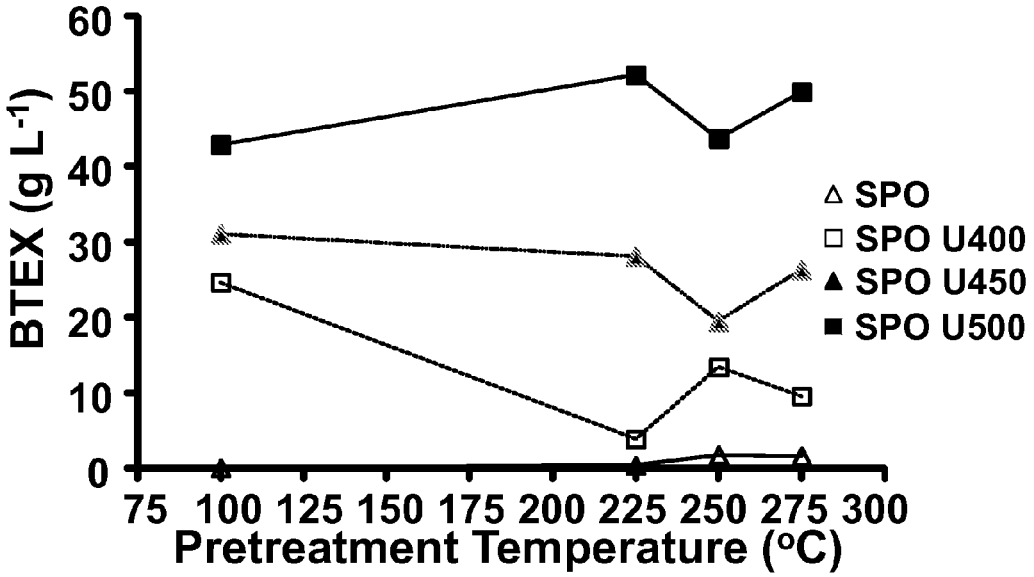
FIGS. 5A-5B are graphs illustrating the concentration of benzene, toluene, ethylbenzene, and xylenes (BTEX) (g $L^{-1}$) in SPO (FIG. 5A) and FPO (FIG. 5B) from feedstock pretreated at 100° C., 225° C., 250° C., and 275° C.
Figure 5B:
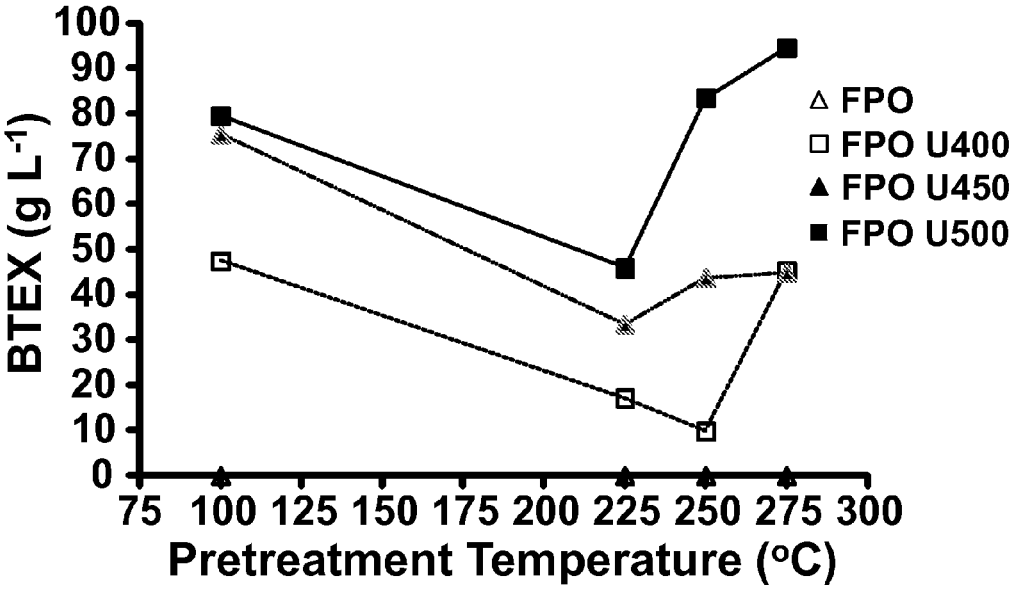

The SP-derived catalytic upgrading control indicated a higher $H/C_{eff}$ than did the FP-derived control oils. However, for all catalytic upgrading temperatures other than the control, FP-derived oils had higher $H/C_{eff}$ with the highest $H/C_{eff}$ at 1.0 indicated by both the FPO T100 U500 and the FPO T275 U500 sample. The lowest $H/C_{eff}$, at −0.3, was produced by the FPO T100 and the FPO T225 feedstocks (no catalytic processing). The highest $H/C_{eff}$ values, at 1.0, corresponded to an increase in BTEX concentration ($H/C_{eff}$ for benzene equals 1) that was particularly prevalent in the FPO-derived product (as shown in FIG. 5B). For FPO T275 U500, the concentration of BTEX was approximately 100 g $L^{-1}$ whereas for the SPO-derived product (FIG. 5A), the concentration was no greater than 50 g $L^{-1}$.

A reduction of the O/C ratio is a good indicator of deoxygenation. The catalytic upgrading process significantly reduced O/C in bio-oils from all preprocessing and pyrolysis processing conditions. For SPO and FPO feedstocks, the average O/C ratio was 0.75 versus 0.275 for upgraded oils, a reduction of 63%. Overall, SP-derived oils had a lower O/C ratio than did FP-derived oils at 0.29 versus 0.49.

As a function of torrefaction, a significant reduction in O/C was seen for T275, T250 and T100 relative to T225. No other pretreatment temperature comparisons proved significant. The temperature at which catalytic cracking was performed also significantly impacted O/C. Bio-oils from all upgrading temperatures had a lower O/C ratio than did the non-catalytically cracked bio-oil control (O/C ratio=0.75). In addition, U500 bio-oil showed reduced O/C ratio relative to that of U400, averaging 0.18 versus 0.375 for U400, a reduction of 53%. Results indicated that torrefaction pretreatment did not significantly affect O/C, although catalytic upgrading was effective at all upgrading temperatures relative to the control.

HHV, a good indicator of the potential applicability of pyrolysis oils and of the optimal levels for CHNS-O, was affected by process conditions in several ways. HHV increased with increasing catalytic processing temperature for all temperature comparisons except for U500 versus U450. Within heating rate groups, HHV varied significantly. For SP, higher catalytic cracking temperature resulted in significantly higher HHV except for U450 (30.7 MJ $kg^{-1}$) versus CTRL (25.8), U400 (29.7) versus CTRL (25.8), and U500 (31.7) versus U450 (25.8). The greatest difference in HHV for SP oils was between the U500 and the control (6.0 MJ $kg^{-1}$ difference).

The same result was obtained for FP derived oils. U500 showed the highest HHV relative to the control (18.9 MJ $kg^{-1}$ increase). Within catalytic processing temperature groups, HHV varied as result of pyrolysis heating rate. Within the catalytic cracking control group, HHV for SPO (25.8 MJ $kg^{-1}$) was significantly higher than for FPO (14.9 MJ $kg^{-1}$). However, for all other catalytic processing temperatures including U400, U450, and U500, the HHV for upgraded FPO was significantly higher at 28.3 MJ $kg^{-1}$, 30.9 MJ $kg^{-1}$, and 33.9 MJ $kg^{-1}$, respectively.

Example 11

Effect of process conditions on catalyst effectiveness: Thee-way ANOVA tests were also used to determine if variables, including torrefaction temperature, pyrolysis heating rate, and catalytic cracking temperature, significantly affected catalyst effectiveness for the production of liquid product (FIGS. 6A and 6B) and BTEX product (FIGS. 6C and 6D).

Figure 6A:
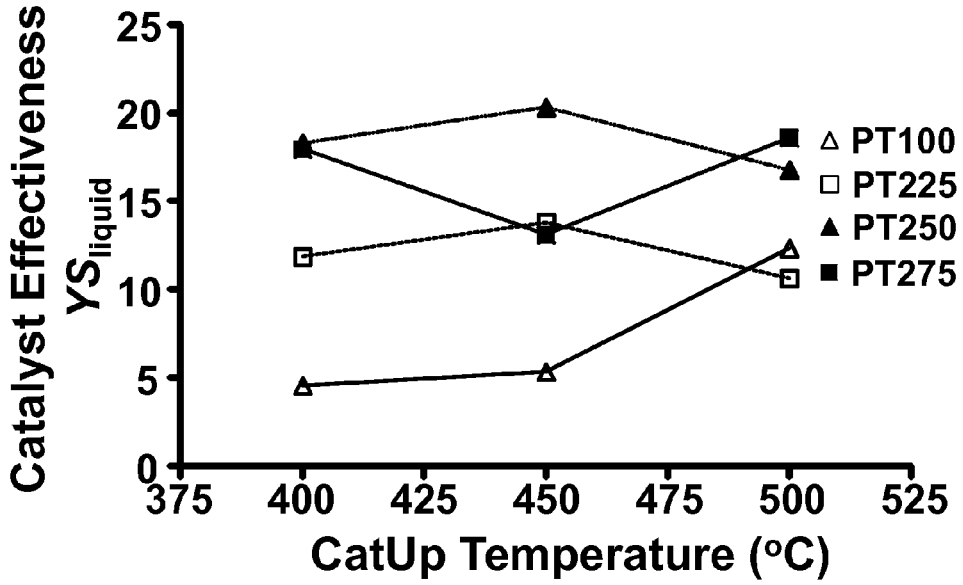
FIGS. 6A-6D is a series of graphs illustrating the catalyst effectiveness for liquid (FIGS. 6A and 6B) and BTEX (FIGS. 6C and 6D) production via HZSM-5 processing of SPO (FIGS. 6A and 6C) and FPO (FIGS. 6B and 6D) derived from pine chips pretreated at 100° C., 225° C., 250° C. and 275° C.
Figure 6B:
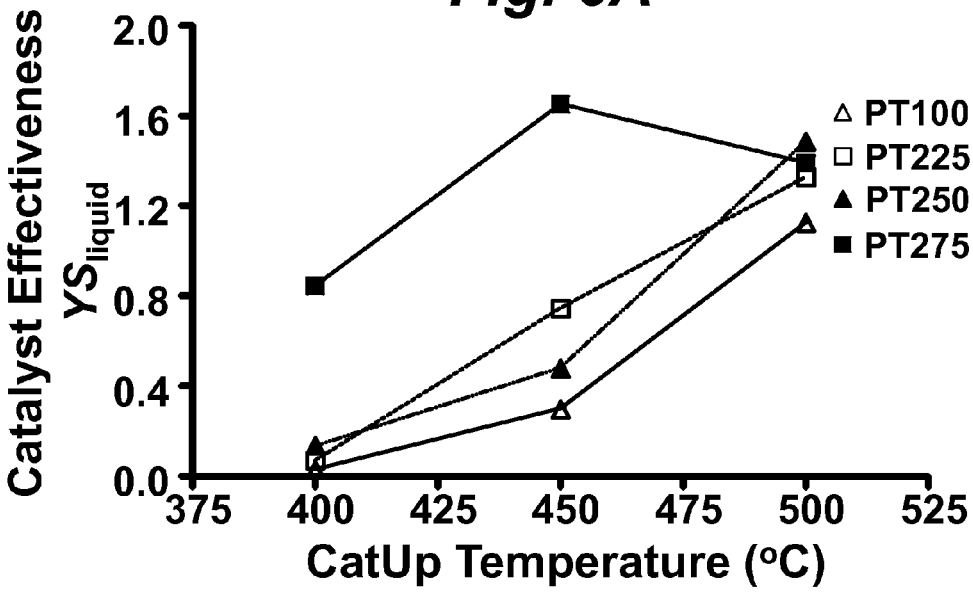

Catalyst effectiveness for liquid production, $C_{eff,liquid}$, was significantly increased by increasing the heating rate and pretreatment temperature, but not by catalytic cracking temperature. However, there was significant interaction between the heating rate and pretreatment temperature. As such, a two-way ANOVA was used on the two groups, SPO- and FPO-processed, separately. For SPO (as shown in FIG. 6A), the pretreatment temperature had a significant positive effect on liquid production effectiveness, i.e. $C_{eff\text{-}liquid}$ increased with increasing processing temperature. Catalytic cracking temperature did not have a significant effect on $C_{eff\text{-}liquid}$ for SPO.

For FPO (FIG. 6B), pretreatment and catalytic cracking temperature significantly affected $C_{eff\text{-}liquid}$. The mean effectiveness was 0.485, 0.885, 0.701, and 1.202 for T100, T225, T250, and T275, respectively, indicating an increase in effectiveness of 148% in the best case scenario relative to the control, T100. The mean effectiveness was 0.201, 0.921, and 1.332 for U400, U450, and U500, respectively, indicating a 503% increase for U500 versus U400. Thus, both pretreatment temperature and catalytic cracking temperature had a positive linear effect on $C_{eff\text{-}liquid}$. For maximum liquid yield relative to SPO or FPO feed, pretreatment at 275° C. and catalytic processing at 500° C. was advantageous.

Figure 6C:
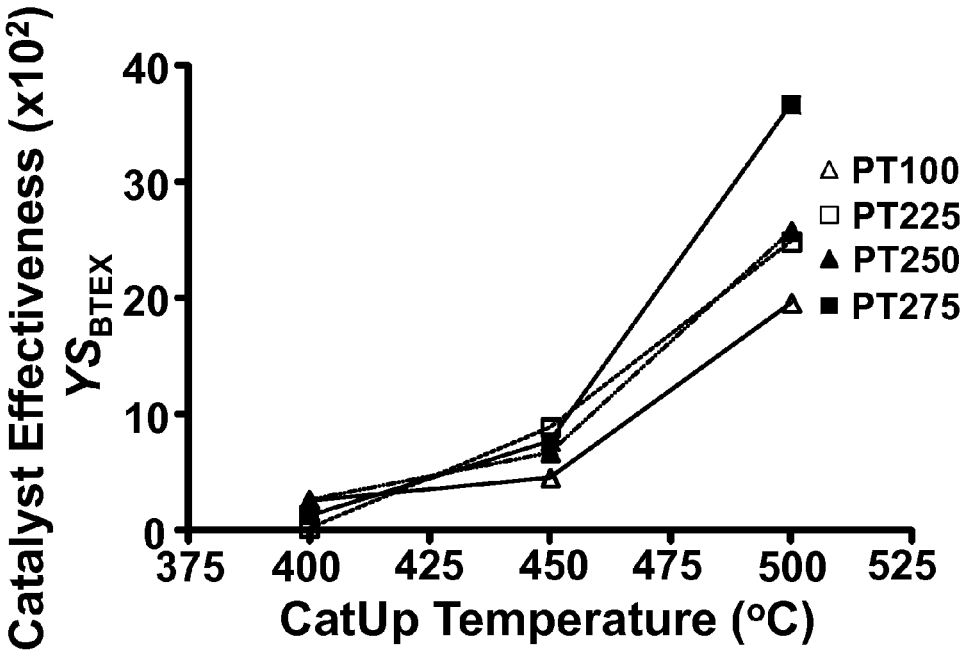
Figure 6D:
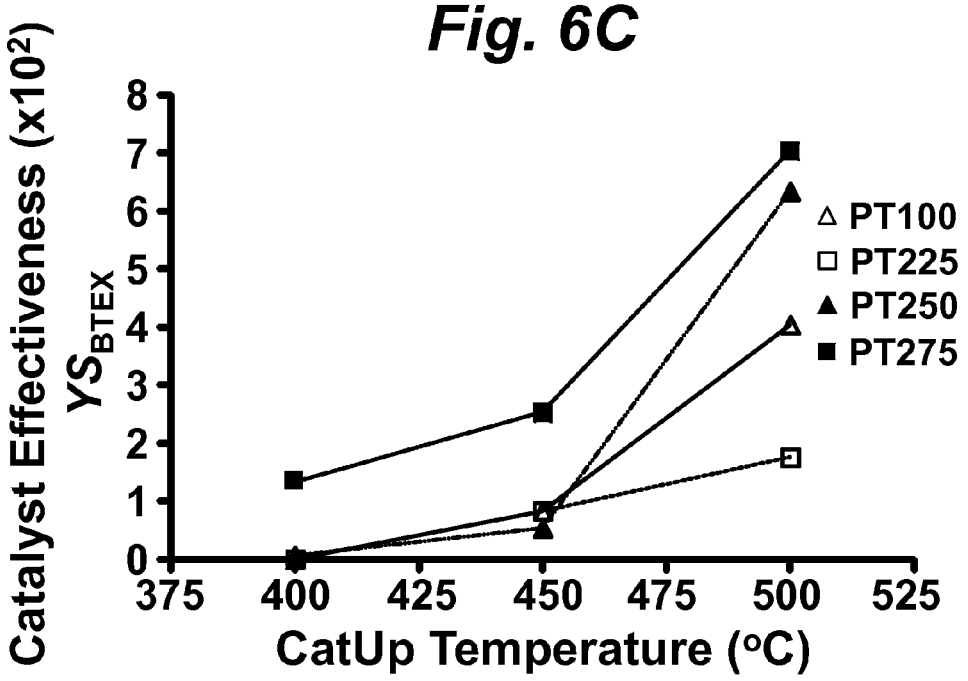

FIGS. 6C and 6D show that catalyst effectiveness for BTEX production, $C_{eff,BTEX}$, increases with increasing catalytic cracking for both SPO and FPO. The 3-way ANOVA indicates that both heating rate and catalytic cracking temperature had a significant effect on $C_{eff,BTEX}$. The difference in the average $C_{eff,BTEX}$ for SPO versus FPO was 9.6, indicating meaning the catalyst was significantly more effective at processing SPO. This is likely due to the high water content in FPO that cannot be converted to BTEX and in practice dilutes species that would form BTEX. An advantageous comparison was possible between processing conditions within each group of pyrolysis heating rate. Within both SPO and FPO processing groups, torrefaction had a significant impact on $C_{eff,BTEX}$ at a torrefaction temperature of 275° C. Catalytic cracking temperature had a major effect, indicating a linear increase with the increasing processing temperature. For the case of the best performing process condition for SPO (at U500), an increase in $C_{eff,BTEX}$ of 71.2% relative to the control was seen. For FPO, the increase was 1250%. The conclusion was that HZSM-5 was significantly more effective at generating BTEX at the upper end of catalytic cracking and torrefaction processing temperature range attempted here, particularly for the upgrading of FPO.

Example 12

Figure 7:
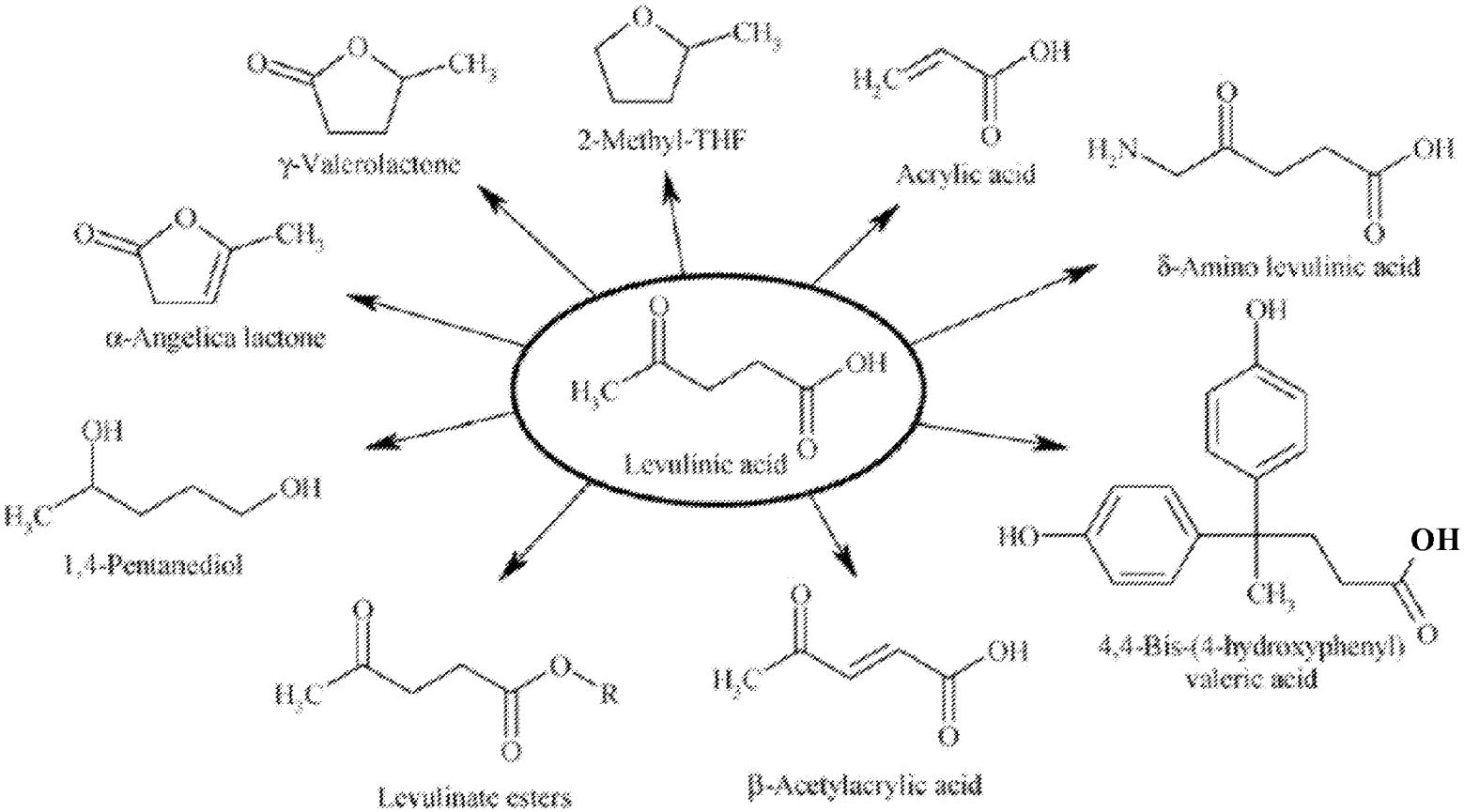
FIG. 7 illustrates the common products derived from the platform molecule levulinic acid (from Girisuta et al., (2006) *Trans. IChemE, Part A, Chem. Eng. Res. Design* 84(A5): 339-349).
Figure 8:
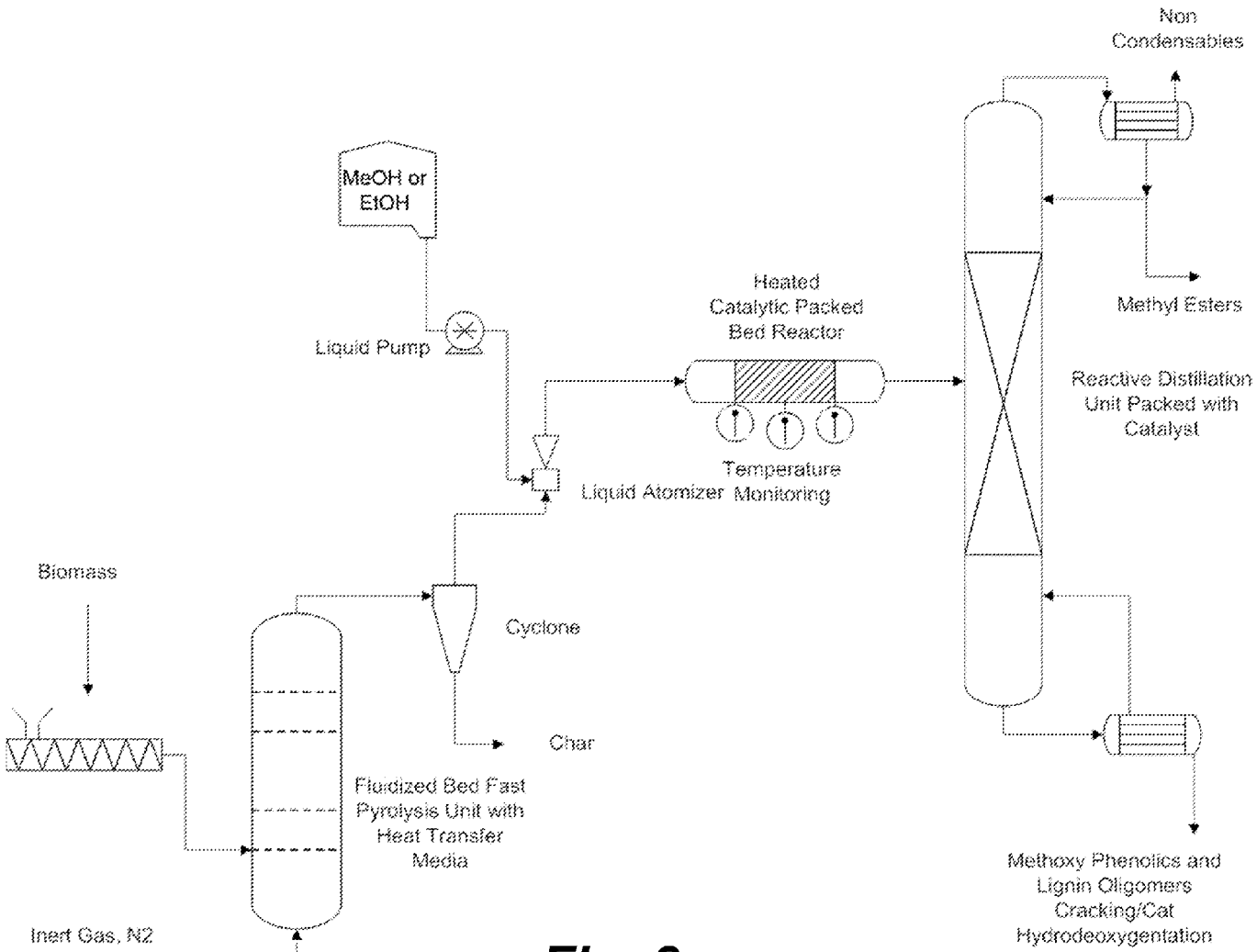
FIG. 8 illustrates a schematic for integrating catalytic esterification with fast pyrolysis to generated platform chemicals and fuels.

The present disclosure also provides a process that incorporates the use of solid acid catalysts to esterify anhydrosugars such as, but not limited to, levoglucosan and carbohydrates in a vapor/liquid state. A schematic of an embodiment of the process is shown in FIG. 8. Levoglucosan can be produced from a range of biomass sources via fast pyrolysis. The catalytic esterification process can use a range of alcohols (e.g., methanol, ethanol) to generate esters that are useful as platform chemicals and fuel substitutes such as shown in FIG. 7.

Several types of plant material have been used to generate fast pyrolysis oil including from pine, switchgrass, napier grass, energy cane, and miscanthus. HPLC analysis (confirmed with GC/MS analysis) indicated that the resulting bio-oils typically contain significant concentrations of formic and acetic acid with lesser amounts of furfural and 5-hydroxymethyl furfural (napier grass seemed to be the exception with respect to at least furfural and 5-hydroxymethyl furfural and significantly lower levels of levoglucosan relative to pine) as shown in Table 5.

TABLE 5

Composition of acids and aldehydes in different fast pyrolysis oils[a] (undiluted).

| Compound (g/L) | Switchgrass | Napier Grass | Miscanthus | Energy Cane | Pine |
|---|---|---|---|---|---|
| Acetic Acid | 90 | 40-50 | 90 | 100 | 72 |
| Formic Acid | 37 | ND[b] | 42 | 50 | 80 |
| 1-Hydroxy-2-Propanone (Acetol) | 14 | 12-15 | 10 | 12-20 | 15-17 |
| Furfural | 4 | ND | 6 | 9.5 | 2.5 |
| 5-HMF | 0.6 | ND | 1.4 | 2.5 | 3.0 |
| Levoglucosan | 22 | 2.0 | 30 | 25 | 130 |

[a]Fast pyrolysis oils generated at 400-500° C.
[b]ND, not detected

In the methods of the disclosure, atomized water vapor was contacted with fast pyrolysis bio-oil vapor/aerosol as the latter was formed. Fast pyrolysis of pine pellets was conducted at 500° C. in an auger-fed fluidized bed reactor where bed material and biomass was fluidized using N2 (20 L/min) and controlled using a thermal mass flow controller. Water vapor was added (between about 79 to about 102 g/h) via a small bore atomizer upstream from the condenser to generate an approximately 1:1 (by weight) water to oil condensate, which was phase separated.

The oil feed rate to the in-line condensation process (ILC) was between about 40 g/h to about 147 g/h and phase separated when collected in a temperature-controlled shell and tube condenser using a circulating ice water bath. The in-line condensation process gave results similar to water extraction of the bio-oil after condensation using a 1:1 water to oil ratio as shown in Table 2. One can see however, that levoglucosan, formate, and acetate concentrations were higher in the water/oil emulsion collected fast pyrolysis oil (Table 6), indicating extraction efficiencies of approximately 40-60%. Regardless, the aqueous phase concentrations in Table 6, as well as those reported in the literature, indicate great potential for conversion to chemicals and fuels. Lignin oligomers are eliminated, and the solution is pumpable, stable, and filterable. Transformation will require a catalyst and reaction pathway capable of functioning in an aqueous environment.

TABLE 6

HPLC and GC/MS analysis of aqueous and non-aqueous phase fast pyrolysis oil (Southern Pine)

| Oil | Levoglucosan (g/L) | Acetol[d] (g/L) | Formate (g/L) | Acetate (g/L) | 5-HMF (g/L) | Furfural (g/L) | Water (%) |
|---|---|---|---|---|---|---|---|
| ILC[a] (aq) | 75-90 | 3.2 | 50-65 | 30-37 | 1.5-1.7 | 0.8-1.0 | Spray |
| FP[b] (aq[c]) | 74 | 5.0 | 57 | 37 | 2.25 | 1.5 | 50 |
| FP (oil) | 130 | 15-17 | 80 | 72 | 3.0 | 2.5 | 20 |
| ENSYN (aq) | 51 | 10.3 | 34 | 50 | 1.0 | 2.4 | 50 |
| ENSYN (oil) | 57 | 36 | NP | 58 | 1.1 | 6.4 | 20 |

[a]ILC, In-line condensation
[b]FP, fast pyrolysis oil
[c]aq, aqueous phase
[d]Acetol: 1-hydroxy-2-propanone The formation of desirable ester products from model compounds present in aqueous bio-oil when processed over several heterogeneous acid catalysts in the vapor phase was shown, including the conversion of levoglucosan to ethyl levulinate (Fernandes et al., (2012) *Applied Catalysis A: General* 425-426, 199-204).

To test the esterification upgrading process for aqueous phase bio-oil, a reactant mixture containing alternately 5 and 10% acetic acid and levoglucosan (levoglucosan) in 80:20 ethanol/water was prepared and subjected to vapor/liquid phase esterification conditions by continuously processing in a fixed bed reactor over several heterogeneous solid acid catalysts including H-ZSM-5, ruthenium on H-ZSM-5, phosphorylated biochar, and AMBERLYST.RTM 70 in hydrogen and nitrogen atmospheres at temperatures from 120-230° C.

Figure 9A:
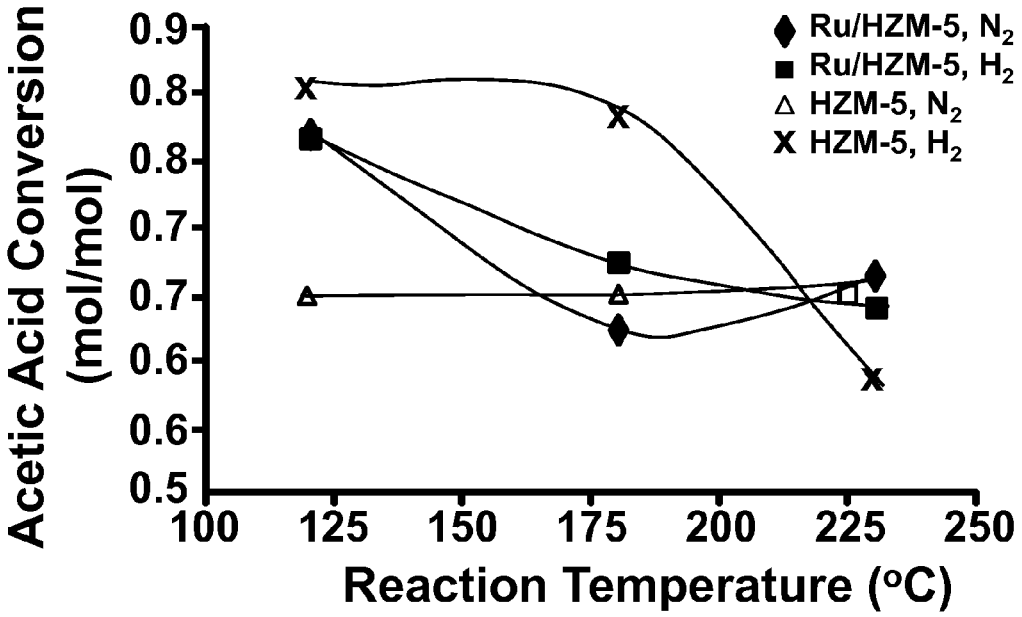
FIG. 9A is a graph illustrating fractional conversion of acetic acid (AcOH) (moles of AcOH converted/moles of AcOH in feed) for acid-catalyzed esterification of an acetic acid/levoglucosan mixture under vapor phase conditions (reaction conditions: P=4.14 MPa, LHSV=5.64 $h^{-1}$, vapor residence time=6.4 s, 5 g of catalyst).
Figure 9B:
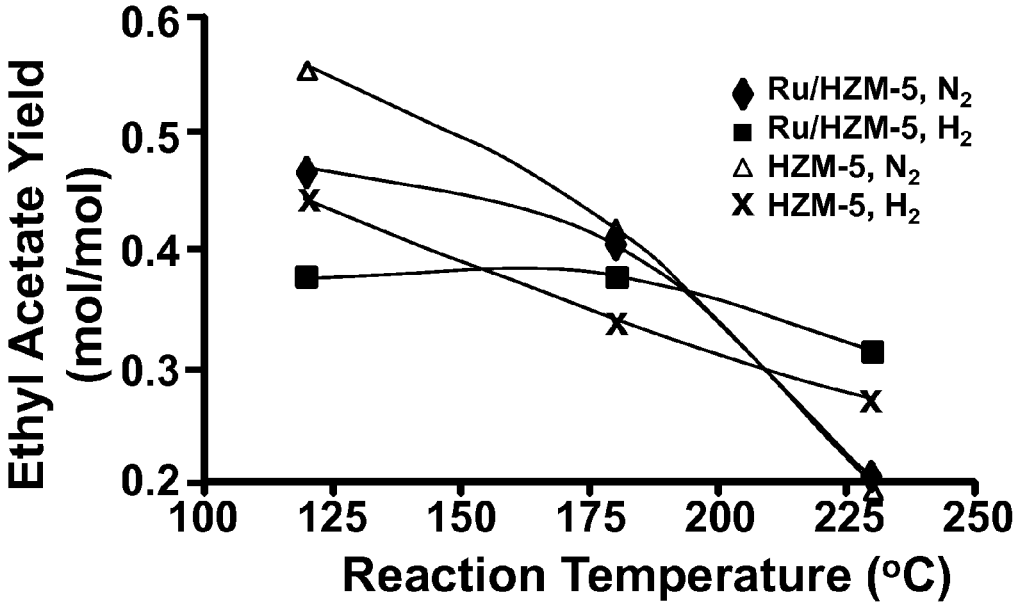
FIG. 9B is a graph illustrating the yield of ethyl acetate ("ethyl acetate", moles of ethyl acetate formed/moles fed) for acid-catalyzed esterification of an acetic acid/levoglucosan mixture under vapor phase conditions (reaction conditions: P =4.14 MPa, LHSV=5.64 $h^{-1}$, vapor residence time=6.4 s, 5 g of catalyst).

Under esterification conditions, acetic acid was transformed into its corresponding ester, ethyl acetate at significant yields. With acidic zeolites, H-ZSM-5 and ruthenium-promoted H-ZSM-5, yields of ethyl acetate were about 55% (moles of ethyl acetate produced/moles of acetic acid in the feed×100) at relatively low temperature (120° C.) and pressure (P=4.14 MPa). The conversion of acetic acid and the yield of ethyl acetate are shown in FIGS. 9A and 9B. Chemical species were identified via GC/MS and quantified by GC/FID and HPLC at both the inlet (i.e. liquid feed was sampled) and the outlet (i.e. condensed liquid products were sampled).

Example 13

The transformation of levoglucosan to esters under vapor/liquid phase conditions was observed as shown in FIGS. 10A-10B and 11A-11B. Thus, the conversion of levoglucosan that resulted in the formation of ethyl levulinate as the major conversion product along with a number of other products including furfural, glucose, and formic acid (low levels), and ethyl formate was observed.

Figure 10A:
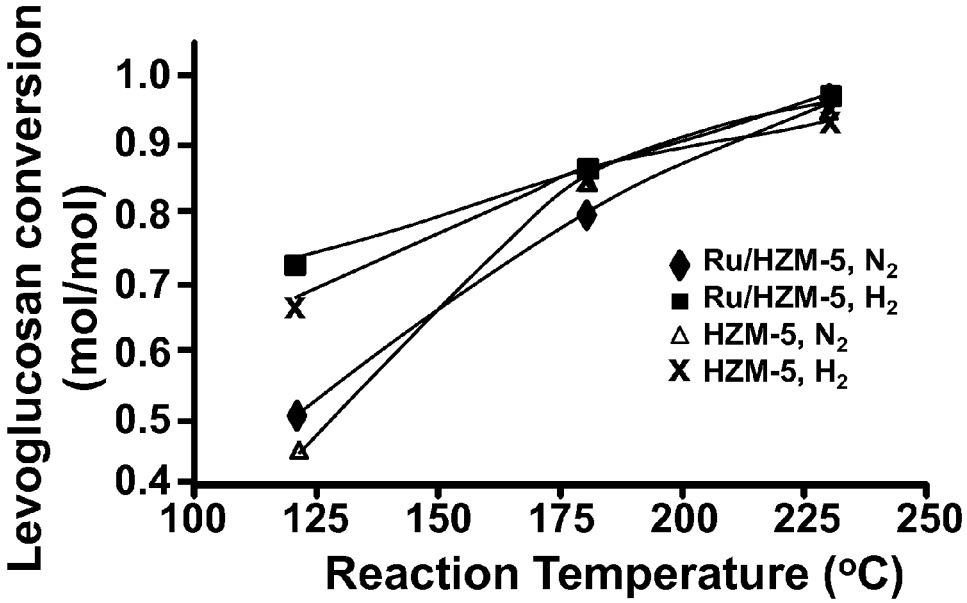
FIG. 10A is a graph illustrating the fractional conversion of levoglucosan (moles of levoglucosan converted/moles of levoglucosan in feed).
Figure 10B:
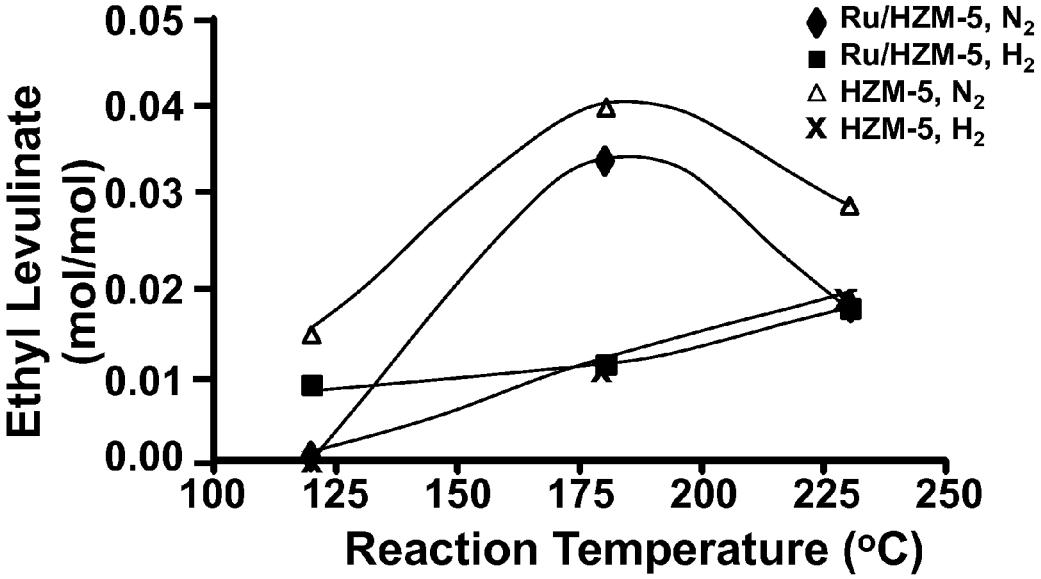
FIG. 10B is a graph illustrating the yield of ethyl levulinate (moles of ethyl levulinate formed/moles of levoglucosan in feed) over acidic catalyst, HZSM-5, in vapor phase (reaction conditions: P=4.14 MPa, LHSV=5.6 $h^{-1}$, vapor residence time=6.4 s, 5 g of catalyst).
Figure 11A:
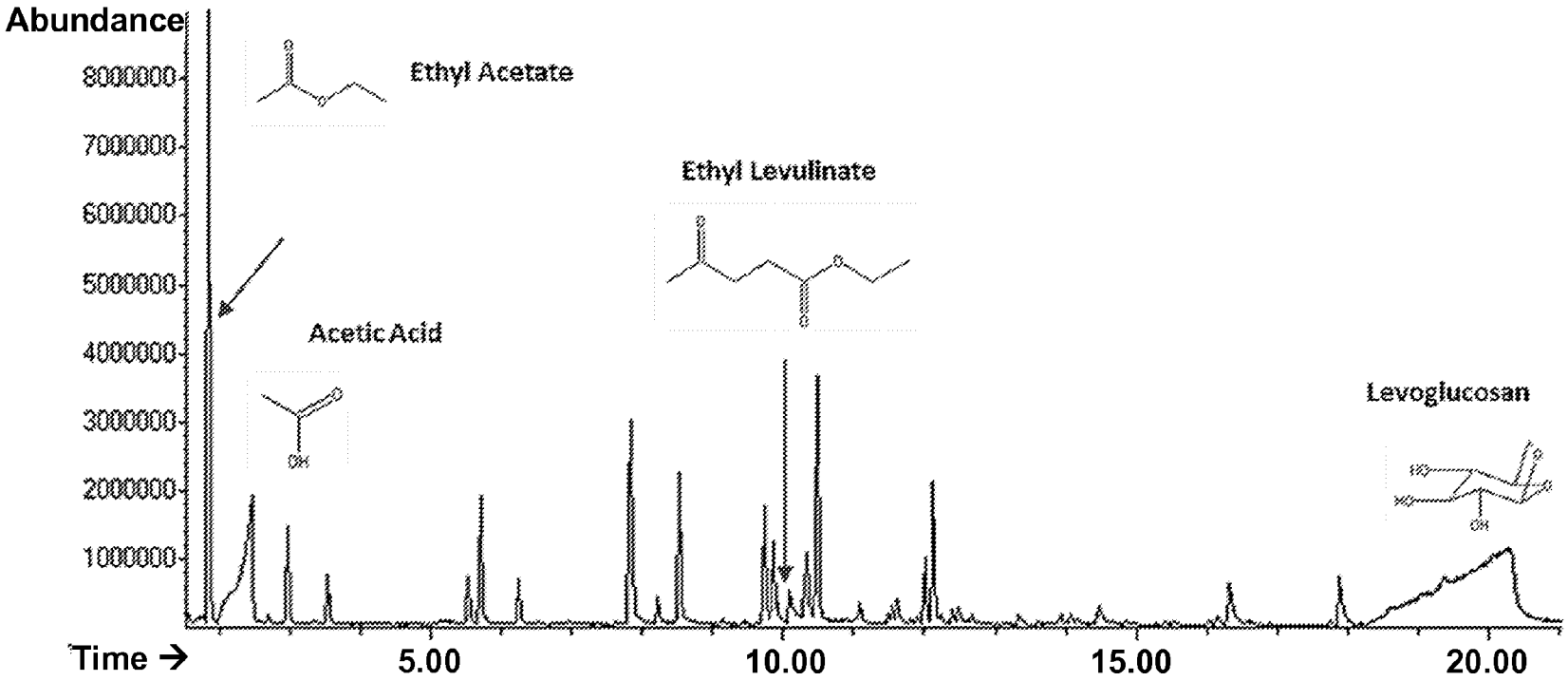
FIG. 11A illustrates the condensed outlet phase of an ethanol/acetic acid/levoglucosan mixture passed across a bed of H-ZSM5 zeolite catalyst at 120° C. The arrows show the formation of ethyl levulinate from levoglucosan and ethyl acetate from acetic acid.
Figure 11B:
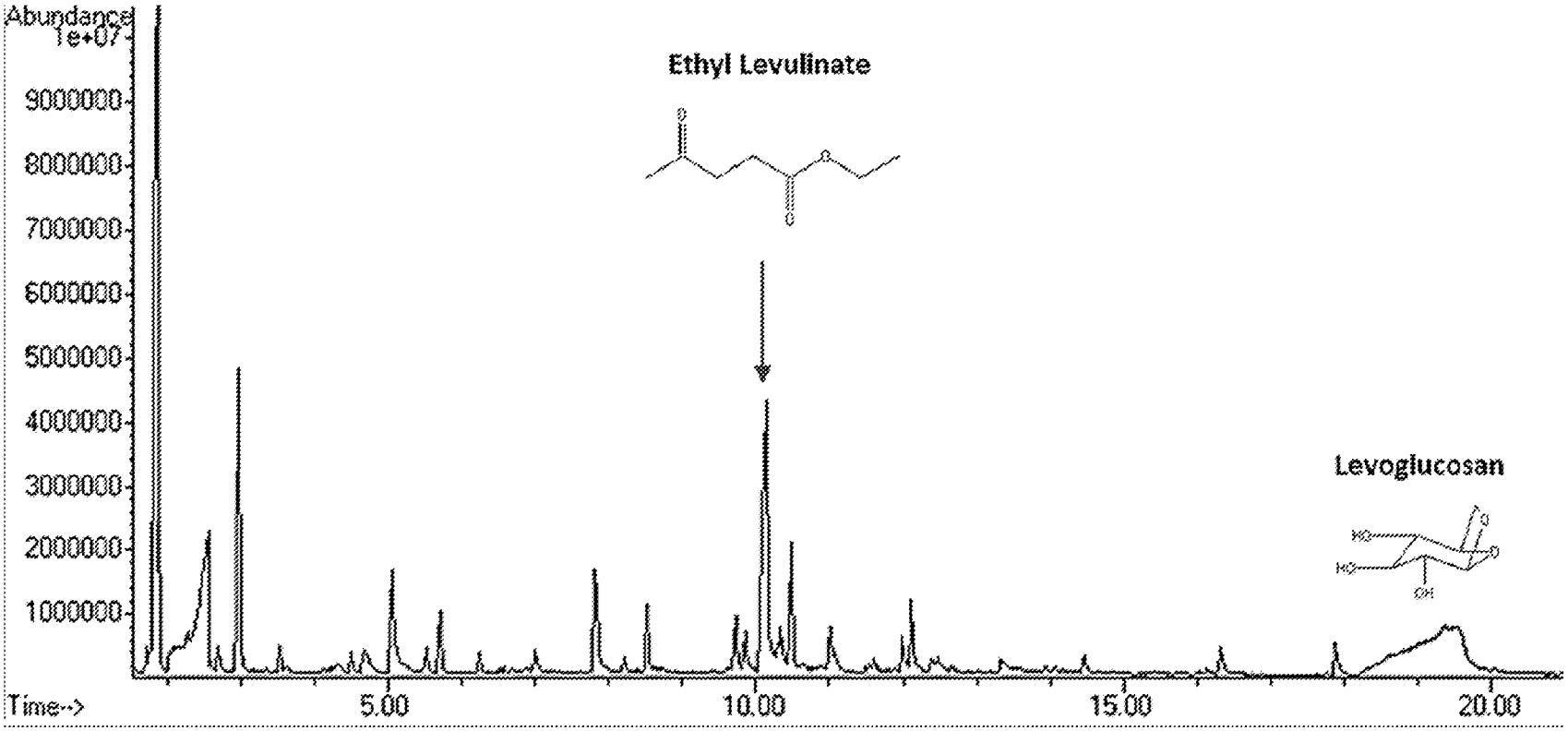
FIG. 11B illustrates the condensed outlet phase of an ethanol/acetic acid/levoglucosan mixture passed across a bed of H-ZSM5 zeolite catalyst at 180° C. The arrows show the formation of ethyl levulinate from levoglucosan and ethyl acetate from acetic acid.

Conversion of levoglucosan approached 100% at 225° C., while the yield of ethyl levulinate reached 4% at 175° C. and a vapor residence time of 6.4 s. FIGS. 10A-10B show the conversion of levoglucosan and yield of ethyl levulinate for each catalyst at temperatures from 120-230° C. FIGS. 11A-11B show the formation of ethyl levulinate via catalytic esterification of levoglucosan using a solid acid catalyst.

What is claimed:

1. A method for reducing coke deposition on a catalyst used in cracking of a pyrolysis oil vapor, the method comprising:

(a) subjecting a biomass to torrefaction;

(b) pyrolyzing the torrefaction-treated biomass, thereby generating a heated pyrolysis oil vapor;

(c) catalytically esterifying the heated pyrolysis oil vapor or components thereof, thereby providing a heated pyrolysis oil vapor having a reduced acid and aldehyde content compared to a heated pyrolysis oil vapor not catalytically esterified; and (d) cracking the catalytically esterified heated pyrolysis oil vapor, thereby generating a bio-oil, wherein said cracking step comprises contacting the heated pyrolysis oil vapor with a second catalyst, and wherein said catalyst accumulates a reduced coke deposition compared to when the heated pyrolysis oil vapor is generated from a biomass not treated with torrefaction.

2. The method of claim 1, wherein in step (c) the heated pyrolysis oil vapor is contacted with an aqueous composition comprising at least one alcohol and a first catalyst selected to catalyze the esterification of at least one component of the heated pyrolysis oil vapor.

3. The method of claim 2, wherein the at least one alcohol is a primary alcohol.

4. The method of claim 2, wherein the at least one alcohol is methanol, ethanol, or a combination thereof.

5. The method of claim 1, wherein the biomass comprises lignocellulose.

6. The method of claim 1, wherein the first catalyst, the second catalyst, or the first and the second catalysts is a solid acid catalyst.

7. The method of claim 6, wherein the catalyst is a zeolite-based catalyst.

8. The process according to claim 1, wherein step (a) comprises heating the biomass at a temperature of between about 100° C. to about 300° C. in an inert gas.

9. The process according to claim 1, wherein the pyrolysis of step (b) is fast pyrolysis.

10. The process according to claim 1, wherein step (b) further comprises fractionating the heated pyrolysis oil vapor into an aqueous phase and a non-aqueous phase by condensing the heated pyrolysis oil vapor and providing the non-aqueous phase for the cracking step (c).

11. A method of generating a bio-oil from a biomass, the method comprising:

(a) subjecting a biomass to torrefaction, wherein the torrefaction comprises heating the biomass at a temperature of between about 100° C. to about 300° C. in an inert gas;

(b) pyrolyzing the torrefaction-treated biomass by fast pyrolysis, thereby generating a heated pyrolysis oil vapor;

(c) catalytically esterifying the heated pyrolysis oil vapor or components thereof, thereby providing a heated pyrolysis oil vapor having a reduced acid and aldehyde content compared to a heated pyrolysis oil vapor not catalytically esterified, wherein the heated pyrolysis oil vapor from step (b) is contacted with an aqueous composition comprising at least one alcohol and a first catalyst selected to catalyze the esterification of at least one component of the heated pyrolysis oil vapor; and (d) cracking the catalytically esterified heated pyrolysis oil vapor, thereby generating a bio-oil, wherein said cracking step comprises contacting the heated pyrolysis oil vapor with a second catalyst, and wherein said catalyst accumulates a reduced coke deposition compared to when the heated pyrolysis oil vapor is generated from a biomass not treated with torrefaction.

12. The method of claim 11, wherein the at least one alcohol is a primary alcohol.

13. The method of claim 12, wherein the at least one alcohol is methanol, ethanol, or a combination thereof.

14. The method of claim 11, wherein the biomass comprises lignocellulose.

15. The method of claim 11, wherein the first catalyst, the second catalyst, or the first and the second catalysts is a solid acid catalyst.

16. The method of claim 3, wherein the first catalyst, the second catalyst, or the first and the second catalysts is a zeolite-based catalyst.

17. The method according to claim 11, wherein step (c) further comprises fractionating the heated pyrolysis oil vapor into an aqueous phase and a non-aqueous phase by condensing the heated pyrolysis oil vapor and providing the non-aqueous phase for the cracking step (d).

18. The method of claim 11, wherein the product of the catalytic esterification comprises an ester selected from the group consisting of: ethyl acetate, ethyl formate, and ethyl levulinate.

* * * * *